US009199814B2

(12) United States Patent
Imai

(10) Patent No.: US 9,199,814 B2
(45) Date of Patent: Dec. 1, 2015

(54) IMAGE FORMING SYSTEM

(71) Applicant: Konica Minolta, Inc., Tokyo (JP)
(72) Inventor: Takuya Imai, Tokyo (JP)
(73) Assignee: KONICA MINOLTA, INC. (JP)

( * ) Notice: Subject to any disclaimer, the term of this patent is extended or adjusted under 35 U.S.C. 154(b) by 371 days.

(21) Appl. No.: 13/862,293
(22) Filed: Apr. 12, 2013
(65) Prior Publication Data
US 2013/0274911 A1 Oct. 17, 2013
(30) Foreign Application Priority Data
Apr. 16, 2012 (JP) ..... 2012-092596
(51) Int. Cl.
*B65H 7/20* (2006.01)
*B65H 3/44* (2006.01)
*G03G 15/23* (2006.01)
*G03G 15/00* (2006.01)
(52) U.S. Cl.
CPC .. *B65H 7/20* (2013.01); *B65H 3/44* (2013.01); *G03G 15/238* (2013.01); *G03G 15/6508* (2013.01); *B65H 2402/10* (2013.01); *B65H 2557/23* (2013.01); *B65H 2557/25* (2013.01); *G03G 2215/00021* (2013.01)
(58) Field of Classification Search
CPC ..... B65H 7/20; B65H 3/44; B65H 2402/10; B65H 2557/25; B65H 2557/23; G03G 15/238; G03G 15/6508; G03G 2215/00021
See application file for complete search history.

(56) References Cited

U.S. PATENT DOCUMENTS 4,717,270 A * 1/1988 Tsutsumi ..... 400/120.04
4,814,831 A * 3/1989 Iwamoto ..... 355/40
5,016,061 A * 5/1991 Tashiro et al. ..... 399/374
5,190,276 A * 3/1993 Namba et al. ..... 271/13
(Continued)

FOREIGN PATENT DOCUMENTS

JP 2006-184476 7/2006
JP 2008-200870 9/2008
(Continued)

OTHER PUBLICATIONS

Translation of Notification of Reasons for Refusal dispatched on Aug. 19, 2014, for related Japanese patent application No. 2012-092596, 4 pages.
(Continued)

*Primary Examiner* — Ramesh Patel
(74) *Attorney, Agent, or Firm* — Squire Patton Boggs (US) LLP

(57) ABSTRACT

An image forming system includes a plurality of image forming apparatuses connected in series along a paper conveying direction. An image forming apparatus provided upstream in the conveying direction among the apparatuses prints one side of a sheet of paper and an image forming apparatus provided downstream prints the other side of the paper. Each of the upstream and downstream image forming apparatuses includes: an image forming unit; a storage unit; and a control unit to send a first information on a paper feed tray of the own image forming apparatus to the other image forming apparatus, receive a second information on a paper feed tray of the other image forming apparatus from the other image forming apparatus, make the storage unit store the first and second information, and make the image forming unit perform image formation based on the first and second information stored in the storage unit.

11 Claims, 13 Drawing Sheets

(56) References Cited

U.S. PATENT DOCUMENTS

| | | | | |
|---|---|---|---|---|
| 5,216,473 | A * | 6/1993 | Maeyama | 399/364 |
| 5,268,728 | A * | 12/1993 | Sugiyama et al. | 399/20 |
| 5,373,349 | A * | 12/1994 | Ito | 399/8 |
| 5,557,387 | A * | 9/1996 | Hatano | 399/381 |
| 5,644,494 | A * | 7/1997 | Richardson et al. | 700/223 |
| 5,774,758 | A * | 6/1998 | Takahashi et al. | 399/1 |
| 6,830,390 | B1 * | 12/2004 | Hayashi | 400/76 |
| 7,495,683 | B2 * | 2/2009 | Takata et al. | 347/116 |
| 2004/0046304 | A1 * | 3/2004 | Itou et al. | 270/32 |
| 2006/0261544 | A1 * | 11/2006 | Tamura et al. | 271/303 |
| 2011/0304092 | A1 * | 12/2011 | Kambayashi et al. | 271/4.02 |
| 2011/0317198 | A1 * | 12/2011 | Suzuki | 358/1.13 |
| 2012/0236340 | A1 * | 9/2012 | Tsuduki | 358/1.12 |
| 2013/0063743 | A1 * | 3/2013 | Matsuki et al. | 358/1.13 |

FOREIGN PATENT DOCUMENTS

| | | |
|---|---|---|
| JP | 2009-298009 | 12/2009 |
| JP | 2012-047770 | 3/2012 |

OTHER PUBLICATIONS

Notification of Reasons for Refusal dispatched on Aug. 19, 2014, for related Japanese patent application No. 2012-092596, 2 pages.

* cited by examiner

IMAGE FORMING SYSTEM

BACKGROUND OF THE INVENTION

1. Field of the Invention

This invention relates to an image forming system.

2. Description of the Related Art

Conventionally, double-side printing by using an image forming apparatus is performed by printing one side of a sheet of paper in an image forming unit and thereafter, conveying the sheet of paper to the image forming unit again to print the other side of the paper. Because of this, productivity is halved in the double-side printing compared to that in single-side printing.

Accordingly, in order to improve the productivity of the double-side printing, an image forming system of a tandem configuration is known, in which a plurality of image forming apparatuses are connected in series along a paper conveying direction, the image forming apparatus provided on the upstream side (upstream device) prints a front side of the paper, and the image forming apparatus provided on the downstream side (downstream device) prints a reverse side of the paper.

For example, a technique is proposed in a system in which two printers are connected in series, in which each of the printers informs the other of error information by serial communication to thereby share the error information (Refer to Japanese Unexamined Patent Application Publication No. 2009-298009). By utilizing the serial communication, the increase in cost caused by adding signal lines between the printers is prevented.

However, in a case of configuring an image forming system of a tandem configuration in which each apparatus developed as a stand-alone image forming apparatus is connected to the other in series, each image forming apparatus cannot recognize a paper feed tray which is not directly connected to the own apparatus. Therefore, if a job includes an instruction accompanying an operation of the paper feed tray which is not directly connected to the own apparatus, the job is determined not executable at each image forming apparatus and error occurs, even if the job is executable in the system.

Further, operations become complicated in each image forming apparatus, to process the job to prevent errors caused by presence of the paper feed tray not directly connected to the own apparatus and to individually change a control program of each image forming apparatus suitable for the tandem configuration.

SUMMARY OF THE INVENTION

The present invention is made to solve at least one of the problems of the conventional art as described above, and an object of the present invention is to simplify construction of the image forming system by sharing information related to paper feed trays connected to respective image forming apparatuses in an image forming system of a tandem configuration.

To achieve the above object, in an image forming system reflecting an aspect of the present invention includes a plurality of image forming apparatuses connected in series along a paper conveying direction, wherein an image forming apparatus provided upstream in the paper conveying direction among the plurality of image forming apparatuses prints one side of a sheet of paper and an image forming apparatus provided downstream with respect to the upstream side image forming apparatus prints the other side of the paper, wherein each of the upstream and downstream image forming apparatuses includes: an image forming unit; a storage unit; and a control unit to send a first information related to a paper feed tray of the own image forming apparatus to the other image forming apparatus, receive a second information related to a paper feed tray of the other image forming apparatus from the other image forming apparatus, make the storage unit store the first and second information, and make the image forming unit perform image formation based on the first and second information stored in the storage unit.

In the above image forming system, it is preferable that each pieces of the first and second information includes information indicating: a type of a paper feed unit to which the paper feed tray belongs; size of paper stored in the paper feed tray; a paper type of the paper stored in the paper feed tray; weight of the paper stored in the paper feed tray; presence/absence of the paper stored in the paper feed tray; a remaining amount of the paper stored in the paper feed tray; an opening/closing state of the paper feed tray; or an adjustment value in the image forming unit for the paper stored in the paper feed tray.

In the above image forming system, it is preferable that: each of the control units in the upstream and downstream image forming apparatuses includes a job control unit to control jobs and a printer control unit to control image formation and paper conveyance; and when the image forming system is powered on, the printer control unit of the upstream image forming apparatus sends the first information to the printer control unit of the downstream image forming apparatus, the printer control unit of the downstream image forming apparatus sends the second information to the printer control unit of the upstream image forming apparatus, the printer control unit of the upstream image forming apparatus sends the second information received from the printer control unit of the downstream image forming apparatus and the first information to the job control unit of the upstream image forming apparatus, and the printer control unit of the downstream image forming apparatus sends the first information received from the printer control unit of the upstream image forming apparatus and the second information to the job control unit of the downstream image forming apparatus.

In the above image forming system, it is preferable that, when the information related to the paper feed tray of the own image forming apparatus stored in the storage unit is changed in the own image forming apparatus, each of the control units of the upstream and downstream image forming apparatuses sends at least the changed pieces of information to the other image forming apparatus, from among the information related to the paper feed tray of the own image forming apparatus.

In the above image forming system, it is preferable that: each of the control units in the upstream and downstream image forming apparatuses includes a job control unit to control jobs and a printer control unit to control image formation and paper conveyance; and when the first information stored in the storage unit is changed in the own image forming apparatus, each of the printer control units of the upstream and downstream image forming apparatuses sends at least the changed pieces of information from among the first information to the job control unit of the own image forming apparatus and the printer control unit of the other image forming apparatus, and the printer control unit of the other image forming apparatus sends the changed information to the job control unit of the other image forming apparatus.

In the above image forming system, it is preferable that: each of the control units in the upstream and downstream image forming apparatuses includes a job control unit to control jobs and a printer control unit to control image formation and paper conveyance; and when the first information stored in the storage unit is changed from an operation section in the own image forming apparatus, each of the job control units of the upstream and downstream image forming apparatuses sends at least the changed pieces of information from among the first information to the printer control unit of the own image forming apparatus and the job control unit of the other image forming apparatus, and the job control unit of the other image forming apparatus sends the changed information to the printer control unit of the other image forming apparatus.

In the above image forming system, it is preferable that: each of the control units in the upstream and downstream image forming apparatuses includes a job control unit to control jobs and a printer control unit to control image formation and paper conveyance; and regarding information including information for a front side of the paper and information for a reverse side of the paper from among the information related to the paper feed tray, each of the control units in the upstream and downstream image forming apparatuses stores therein both pieces of information for the front side of the paper and the reverse side of the paper, the printer control unit of the upstream image forming unit reads out the information for the front side stored in the storage unit of the upstream image forming apparatus and causes the image forming unit of the upstream image forming apparatus to perform image formation for the front side of the paper based on the readout information for the front side, and the printer control unit of the downstream image forming unit reads out the information for the reverse side stored in the storage unit of the downstream image forming apparatus and causes the image forming unit of the downstream image forming apparatus to perform image formation for the reverse side of the paper based on the read out information for the reverse side.

BRIEF DESCRIPTION OF THE DRAWINGS

The present invention will become fully understood from the detailed description given hereinafter and the accompanying drawings, but the description and the drawings are not intended to limit the present invention, and wherein:

FIG. 5 is a view for explaining a synchronization process of paper feed tray information executed upon powering on;

FIG. 6A is a view showing an example of the paper feed tray information that is recognized in a job control unit of the upstream device, after performing the synchronization of the paper feed tray information upon powering on;

FIG. 6B is a view showing an example of the paper feed tray information that is recognized in a job control unit of the downstream device, after performing the synchronization of the paper feed tray information upon powering on;

DETAILED DESCRIPTION OF THE EMBODIMENTS

First Embodiment

Hereafter, a first embodiment of an image forming system according to the present invention is described with reference to FIGS. 1 to 8.

(Configuration of the Image Forming System)

Figure 1:
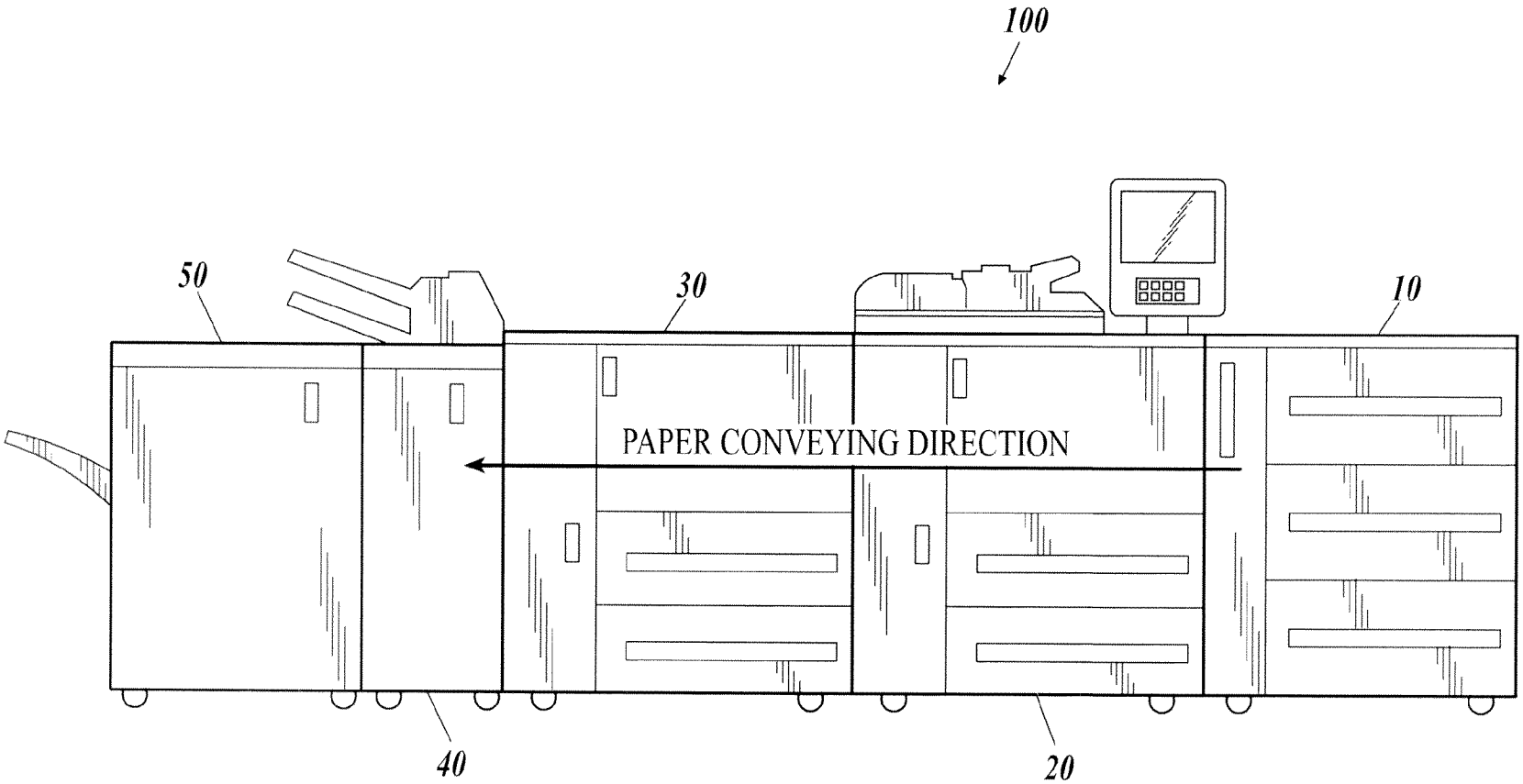
FIG. 1 is an external configuration view of an image forming system.

FIG. 1 is an external configuration view of an image forming system 100.

As shown in FIG. 1, the image forming system 100 has a tandem configuration in which a paper feed unit 10 for transfer paper, an upstream image forming apparatus (hereinafter, referred to as an upstream device) 20, a downstream image forming apparatus (hereinafter, referred to as a downstream device) 30, a paper feed unit 40 for cover paper insertion, a finisher (FNS or post processing unit) 50 are connected in series along a paper conveying direction. Although each of the upstream device 20 and the downstream device 30 is developed as a stand-alone image forming apparatus, the upstream device 20 and the downstream device 30 are connected together so that the upstream device 20 prints one side of a sheet of paper and the downstream device 30 prints the other side of the paper, achieving high-speed double-side printing.

The paper feed unit 10 for transfer paper is referred to as a paper feed unit (PFU), and includes paper feed means consisting of a plurality of paper feed trays, paper feed rollers, separation rollers, feed/separation rubbers, pick-up rollers and the like. The paper is stored in the separate paper feed trays according to types thereof (such as paper type, weight and size), and conveyed one by one by the paper feed means to the upstream device 20 from the topmost sheet of the stored paper.

The upstream device 20 forms an image on the sheet of paper on the basis of print data in a page description language format (e.g., PDL format and Tiff format) received from an external device and the like and print setting data (a print job), or forms an image on the sheet of paper on the basis of image data read out from an original document.

The downstream device 30 forms an image on the sheet of paper, likewise to the upstream device 20.

The paper feed unit 40 for cover paper insertion is provided for inserting a sheet of cover paper into a bundle of sheets of paper on which images are formed by the upstream device 20 and/or the downstream device 30, and includes paper feed means consisting of a plurality of paper feed trays, paper feed rollers, separation rollers, feed/separation rubbers, pick-up rollers and the like. The sheets of cover paper are set in the separate paper feed trays according to types thereof (such as paper type, weight and size), and inserted one by one by the paper feed means into a predetermined position of the bundle of sheets of paper discharged from the downstream device 30.

The FNS 50 includes various post processing units such as sort, staple, punch, and fold units and a discharge tray and the like, performs various post processes on the sheets of paper discharged from the downstream device 30, and discharges the post-processed sheets of paper onto the discharge tray.

Figure 2:
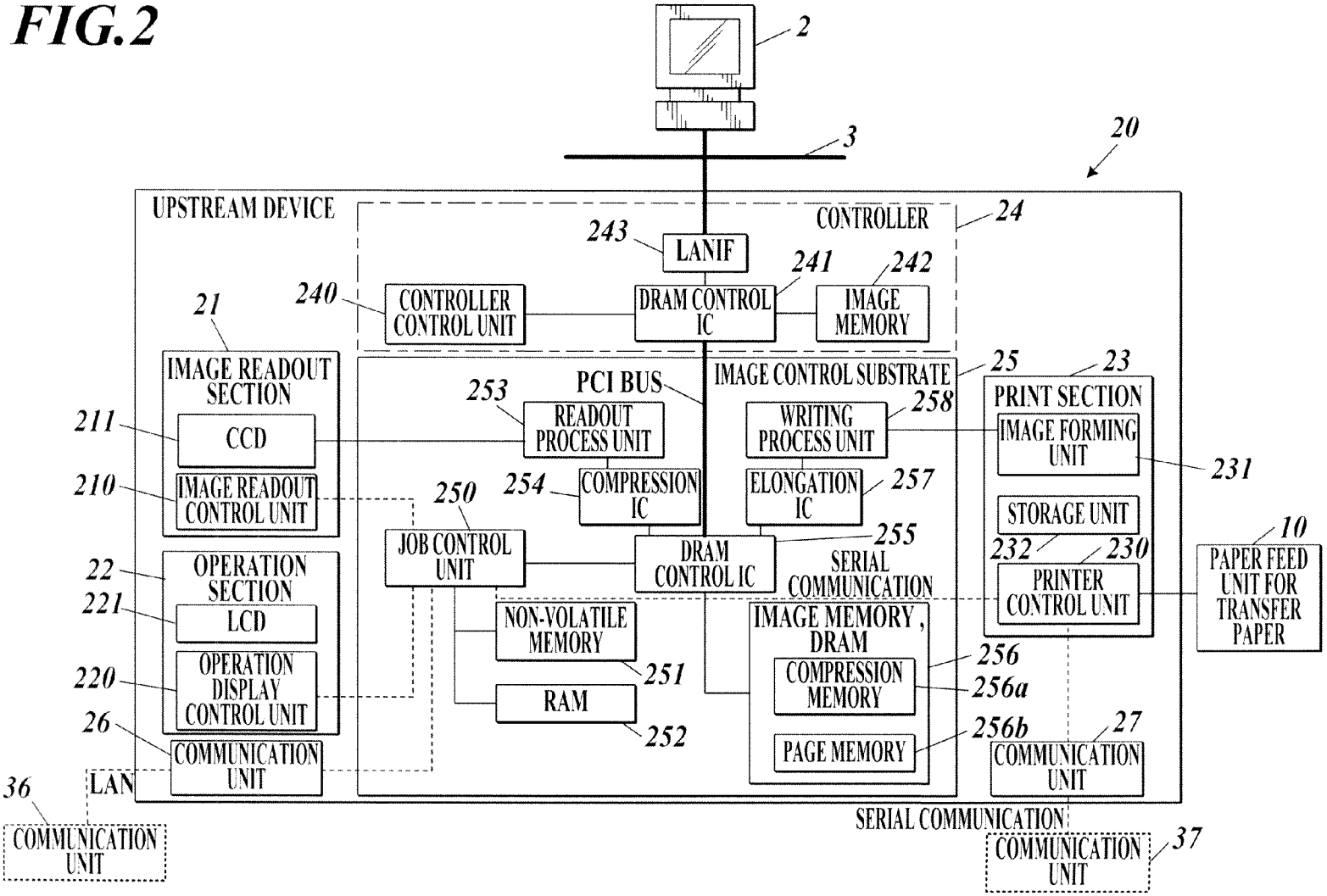
FIG. 2 is a block diagram showing a functional configuration of an upstream device.

FIG. 2 is a block diagram showing a functional configuration of the upstream device 20.

As shown in FIG. 2, the upstream device 20 is configured to include an image readout section 21, an operation section 22, a print section 23, a controller 24, an image control substrate 25, a communication unit 26, a communication unit 27 and the like. The upstream device 20 is connected to an external device 2 on a network 3 through a local area network interface (LANIF) 243 of the controller 24, so that intercommunication of data becomes possible.

The image readout section 21 includes an image readout control unit 210, a charged coupled device (CCD) 211, an automatic original document feeding unit which is called an auto document feeder (ADF), and the like, and reads images on the original document. The original document placed on an original document tray of the automatic original document feeding unit is conveyed onto a contact glass and one side or both sides of the original document is read by the CCD 211. The image readout control unit 210 controls operations of the respective units in the image readout section 21 according to instructions from a job control unit 250, and causes the plurality of images on the original document to be read. Analog image data read by the image readout section 21 is then outputted to a readout process unit 253.

The operation section 22 is configured to include an operation display control unit 220, a liquid crystal display (LCD) 221, a touch panel provided to cover the LCD 221, various buttons, a numerical keypad, an operation key group and the like. The operation display control unit 220 causes the LCD 221 to display thereon various screens for inputting various setting conditions, various process results, or the like, according to display signals inputted from the job control unit 250. Further, the operation display control unit 220 outputs operation signals inputted by using the various buttons, numerical keypad, operation key group, touch panel or the like to the job control unit 250.

The print section 23 performs image forming processing in an electrophotographic format, and includes a printer control unit 230, an image forming unit 231, a storage unit and the like.

The printer control unit 230 is configured to include a central processing unit (CPU) and the like, and controls image formation and paper conveyance in the upstream device 20 in cooperation with a printer control program stored in the storage unit 232. The printer control unit 230 controls operations of the respective units in the print section 23 according to instructions from the job control unit 250, and causes the image formation to be performed on the basis of print image data inputted from a writing process unit 258.

Further, the printer control unit 230 acquires information related to the paper feed tray from the paper feed unit 10 for transfer paper (hereinafter, referred to as paper feed tray information). In the paper feed tray information, a type of a paper feed unit to which the paper feed tray belongs (identification information of the paper feed unit, a number of stages in the paper feed tray, and the like), size of paper stored in the paper feed tray, a paper type of the paper stored in the paper feed tray, weight of the paper stored in the paper feed tray, presence/absence of the paper stored in the paper feed tray, a remaining amount of the paper stored in the paper feed tray, and an opening/closing state of the paper feed tray, and an adjustment value in each of the image forming unit 231 and an image forming unit 331 (see FIG. 3) for the paper stored in the paper feed tray. Here, the paper feed unit 10 for transfer paper is a unit controlled by the upstream device 20, and hereinafter, the paper feed tray information of the upstream device 20 includes the paper feed tray information of the paper feed unit 10 for transfer paper.

Still further, the printer control unit 230 sends/receives data to/from a printer control unit 330 (see FIG. 3) of the downstream device 30 through the communication unit 27.

The image forming unit 231 is configured to include a photosensitive drum, a charging unit for charging the photosensitive drum, an exposure unit for exposure scanning the photosensitive drum surface on the basis of image data, a development unit for adhering toner on the photosensitive drum, a transfer unit for transferring a toner image formed on the photosensitive drum on a sheet of paper, a fixing unit for fixing the toner image formed on the sheet of paper, and the like.

Additionally, the image forming unit 231 is not limited to the example in which the electrophotographic format is applied, but one in which other printing format such as an ink-jet format or a thermal sublimation format may be applied.

The storage unit 232 stores printer control programs for image formation and paper conveyance, various data, and also, processed data and the like.

The controller 24 is provided to manage and control data inputted from the external device 2 connected to the network 3 into the image forming system 100, receives data for printing from the external device 2 (print data and print setting data), sends image data generated by decompressing the print data and print setting data to the image control substrate 25.

The controller 24 is configured to include a controller control unit 240, a dynamic random access memory (DRAM) control IC 241, an image memory 242, the LANIF 243 and the like.

The controller control unit 240 performs overall control of operations in the respective units in the controller control unit 240, and generates image data in a bitmap format after decompressing the print data inputted from the external device 2 through the LANIF 243.

The DRAM control IC 241 controls transfer of the print data received at the LANIF 243 to the controller control unit 240 and write/readout of the image data and the print setting data to/from the image memory 242. Also, the DRAM control IC 241 is connected to a DRAM control IC 255 of the image control substrate 25 through a peripheral components interconnect (PCI) bus, and reads out the image data to be printed and the print setting data from the image memory 242 and outputs the same to the DRAM control IC 255.

The image memory 242 is configured with a non-volatile memory such as a DRAM, and temporarily stores the image data and the print setting data.

The LANIF 243 is a communication interface such as a network interface card (NIC), a modem or the like for enabling connection to the network 3, and receives the print data and the print setting data from the external device 2. The received pieces of print data and print setting data are outputted to the DRAM control IC 241.

The image control substrate 25 includes the job control unit 250, a non-volatile memory 251, a random access memory (RAM) 252, the readout process unit 253, a compression IC 254, the DRAM control IC 255, an image memory 256, an elongation IC 257, the writing process unit 258 and the like.

The job control unit 250 is configured with a CPU or the like, reads out a job control program stored in the non-volatile memory 251, decompresses the same in the RAM 252, executes various processes in cooperation with the program decompressed in the RAM 252, and performs centralized control of the respective units in the upstream device 20. The job control unit 250 receives the print job received at the controller 24 and controls the image data and the job.

Further, the job control unit 250 acquires the paper feed tray information set by the operation section 22.

Still further, the job control unit 250 sends/receives data to/from a job control unit 350 (see FIG. 3) of the downstream device 30 through the communication unit 26.

The non-volatile memory 251 stores job control programs for executing and controlling the job, various data, and also, processed data and the like.

The RAM 252 forms a work area for temporarily storing various programs executed by the job control unit 250 and various data used by the programs.

Moreover, the RAM 252 temporarily stores job data generated by the job control unit 250 on the basis of the image data and the print setting data inputted from the controller 24, or setting information set by the operation section 22.

The readout process unit 253 generates digital image data after treating analog image data inputted from the image readout section 21 with an analog process, an A/D conversion process, a shading process and the like. The generated image data is outputted to the compression IC 254.

The compression IC 254 compresses the inputted digital image data to output the same to the DRAM control IC 255.

The DRAM control IC 255 controls input/output of the image data to/from the image memory 256, along with the control of the compression process of the image data by the compression IC 254 and an elongation process of the compressed image data by the elongation IC 257.

For example, when storing instruction of the image data read out from the image readout section 21 is inputted from the job control unit 250, the DRAM control IC 255 causes the compression IC 254 to execute the compression process of the image data inputted into the readout process unit 253 and a compression memory 256*a* of the image memory 256 to store the compressed image data. Also, when the image data is inputted from the DRAM control IC 241 of the controller 24, the DRAM control IC 255 causes the compression IC 254 to execute the compression process of the image data and the compression memory 256*a* of the image memory 256 to store the compressed image data.

Further, when print out instruction of the compressed image data stored in the compression memory 256*a* is inputted from the job control unit 250, the DRAM control IC 255 reads out the compressed image data from the compression memory 256*a* and causes a page memory 256*b* to store the same after performing the elongation process thereon by the elongation IC 257. Still further, when print out instruction of the image data stored in the page memory 256*b* is inputted, the DRAM control IC 255 reads out the image data from the page memory 256*b* and outputs the same to the writing process unit 258.

The image memory 256 includes the compression memory 256*a* and the page memory 256*b* each of which is configured by a DRAM. The compression memory 256*a* is a memory to store the compressed image data, and the page memory 256*b* is a memory to temporarily store the image data to be printed out or the image data received from the controller 24 before compression.

The elongation IC 257 performs the elongation process on the compressed image data.

The writing process unit 258 generates the image data to be printed out for the image formation on the basis of the image data inputted from the ID control IC 255 and outputs the same to the print section 23.

The communication unit 26 is a communication interface for making connection with the job control unit 350 (see FIG. 3) of the downstream device 30, and sends/receives various data to/from a communication unit 36 (see FIG. 3) of the downstream device 30 through a LAN.

The communication unit 27 is a communication interface for making connection with the printer control unit 330 (see FIG. 3) of the downstream device 30, and sends/receives various data to/from a communication unit 37 (see FIG. 3) of the downstream device 30 through a serial communication line.

Figure 3:
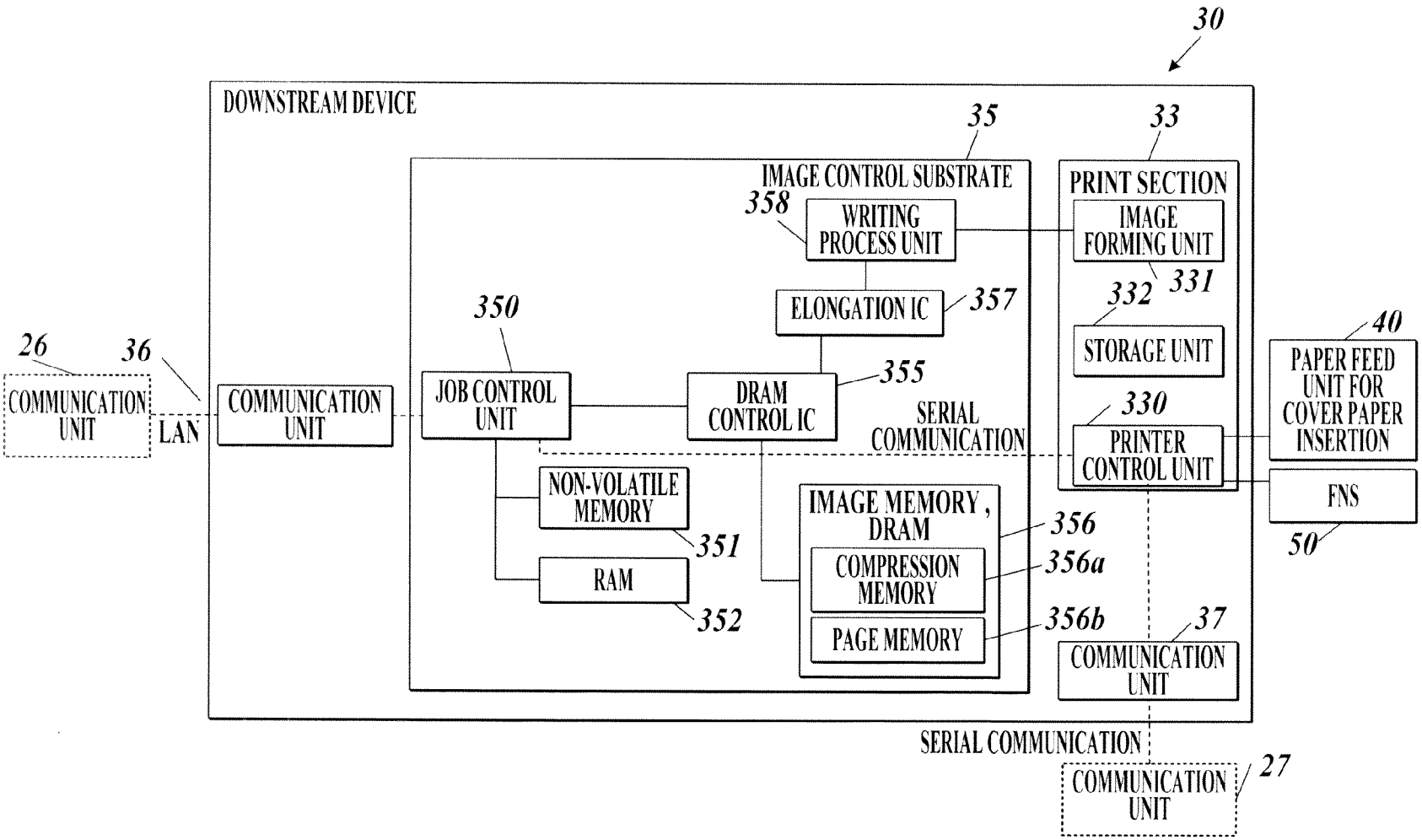
FIG. 3 is a block diagram showing a functional configuration of a downstream device.

FIG. 3 is a block diagram showing a functional configuration of the downstream device.

As shown in FIG. 3, the downstream device 30 is configured to include a print section 33, an image control substrate 35, the communication unit 36, the communication unit 37 and the like.

The print section 33 performs image forming processing in the electrophotographic format, and includes the printer control unit 330, the image forming unit 331, a storage unit 332 and the like.

The printer control unit 330 is configured to include a CPU and the like, and controls image formation and paper conveyance in the downstream device 30 in cooperation with a printer control program stored in the storage unit 332. The printer control unit 330 controls operations of the respective units in the print section 33 according to instructions from the job control unit 350, and causes the image formation to be performed on the basis of print image data inputted from a writing process unit 358.

Further, the printer control unit 330 acquires the paper feed tray information from the paper feed unit 40 for cover paper insertion. Here, the paper feed unit 40 for cover paper insertion is a unit controlled by the downstream device 30, and hereinafter, the paper feed tray information of the downstream device 30 includes the paper feed tray information of the paper feed tray 40 for cover paper insertion.

Still further, the printer control unit 330 acquires information related to post processes from the FNS 50.

Also, the printer control unit 330 sends/receives data to/from the printer control unit 230 of the upstream device 20 through the communication unit 37.

The image forming unit 331 has the same configuration as the image forming unit 231, therefore, the description is omitted.

The storage unit 332 stores the printer control programs for image formation and paper conveyance, various data, and also, the processed data and the like.

The image control substrate 35 includes the job control unit 350, a non-volatile memory 351, a random access memory (RAM) 352, a DRAM control IC 355, an image memory 356, an elongation IC 357, the writing process unit 358 and the like.

The job control unit 350 is configured with the CPU or the like, reads out a job control program stored in the non-volatile memory 351, decompresses the same in the RAM 352, executes various processes in cooperation with the program decompressed in the RAM 352, and performs centralized control of the respective units in the downstream device 30. The job control unit 350 receives the print job send from the job control unit 250 of the upstream device 20 and controls the image data and the job.

Further, the job control unit 350 sends/receives data to/from the job control unit 250 of the upstream device 20 through the communication unit 36.

The non-volatile memory 351 stores the job control programs for executing and controlling the job, various data, and also, the processed data and the like.

The RAM 352 forms a work area for temporarily storing various programs executed by the job control unit 350 and various data used by the programs.

Also, the RAM 352 temporarily stores the job data inputted from the upstream device 20 through the communication unit 36.

The DRAM control IC 355 controls input/output of the image data to/from the image memory 356, along with the control of the elongation process of the compressed image data by the elongation IC 257.

For example, when pieces of the job data and the compressed image data are inputted from the communication unit 36, the DRAM control IC 355 causes the RAM 352 to store the job data and a compression memory 356*a* of the image memory 356 to store the compressed image data.

Further, when print out instruction of the compressed image data stored in the compression memory 356*a* is inputted from the job control unit 350, the DRAM control IC 355 reads out the compressed image data from the compression memory 356*a* and causes a page memory 356*b* to store the same after performing the elongation process thereon by the elongation IC 357. Still further, when print out instruction of the image data stored in the page memory 356*b* is inputted, the DRAM control IC 355 reads out the image data from the page memory 356*b* and outputs the same to the writing process unit 358.

The image memory 356 includes the compression memory 356*a* and the page memory 356*b* each of which is configured by a DRAM. The compression memory 356*a* is a memory to store the compressed image data, and the page memory 356*b* is a memory to temporarily store the image data to be printed out.

The elongation IC 357 performs the elongation process on the compressed image data.

The writing process unit 358 generates the image data to be printed out for the image formation on the basis of the image data inputted from the DRAM control IC 355 and outputs the same to the print section 33.

The communication unit 36 is a communication interface for making connection with the job control unit 250 of the upstream device 20, and sends/receives various data to/from a communication unit 26 of the upstream device 20 through the LAN.

The communication unit 37 is a communication interface for making connection with the printer control unit 230 of the upstream device 20, and sends/receives various data to/from a communication unit 27 of the upstream device 20 through the serial communication line.

The job control unit 250 or the printer control unit 230 (control units of the upstream device 20) sends the paper feed tray information of the upstream device 20 to the downstream device 30, receives the paper feed tray information of the downstream device 30 therefrom, causing the non-volatile memory 251 and/or the storage unit 232 to store the paper feed tray information of the upstream device 20 and the paper feed tray information of the downstream device 30, and causes the image forming unit 231 to perform the image formation on the basis of the paper feed tray information of the upstream device 20 and the paper feed tray information of the downstream device 30 stored in the non-volatile memory 251 and/or the storage unit 232.

The job control unit 350 or the printer control unit 330 (control units of the downstream device 30) sends the paper feed tray information of the downstream device 30 to the upstream device 20, receives the paper feed tray information of the upstream device 20 therefrom, causing the non-volatile memory 351 and/or the storage unit 332 to store the paper feed tray information of the upstream device 20 and the paper feed tray information of the downstream device 30, and causes the image forming unit 331 to perform the image formation on the basis of the paper feed tray information of the upstream device 20 and the paper feed tray information of the downstream device 30 stored in the non-volatile memory 351 and/or the storage unit 332.

Specifically, when the image forming system 100 is powered on, the printer control unit 230 of the upstream device 20 sends the paper feed tray information of the upstream device 20 to the printer control unit 330 of the downstream device 30.

The printer control unit 330 of the downstream device 30 sends the paper feed tray information of the downstream device 30 to the printer control unit 230 of the upstream device 20.

The printer control unit 230 of the upstream device 20 sends the paper feed tray information of the downstream device 30 received from the printer control unit 330 of the downstream device 30 and the paper feed tray information of the upstream device 20 to the job control unit 250 of the upstream device 20.

The printer control unit 330 of the downstream device 30 sends the paper feed tray information of the upstream device 20 received from the printer control unit 230 of the upstream device 20 and the paper feed tray information of the downstream device 30 to the job control unit 350 of the downstream device 30.

(Print Operation in a Tandem Configuration)

Figure 4:
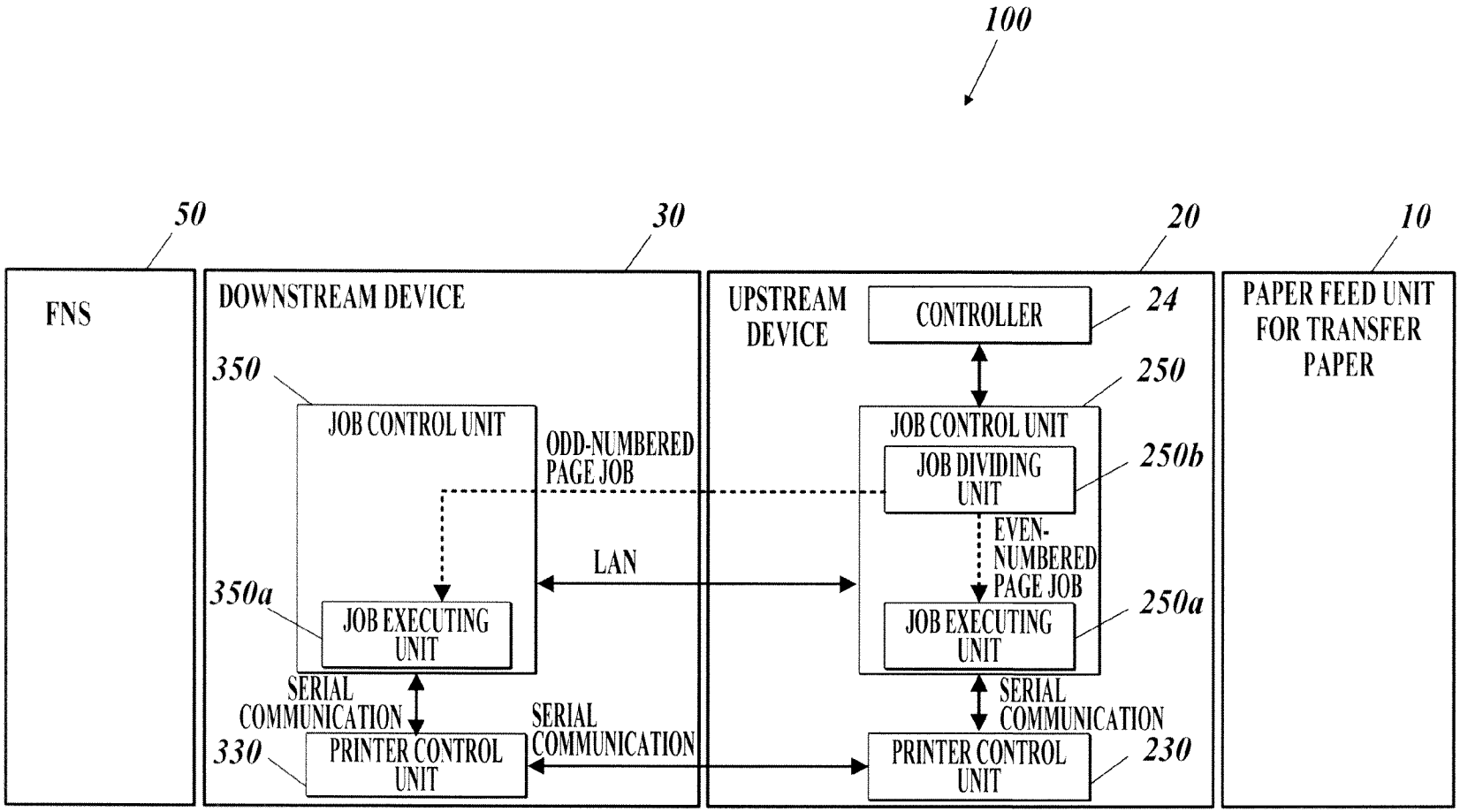
FIG. 4 is a schematic block diagram of the image forming system.

FIG. 4 is a schematic block diagram of the image forming system 100.

When the image forming system 100 is operated as a single system, by connecting stand-alone image forming apparatuses (the upstream device 20 and the downstream device 30), new communication lines are provided. Here, other than the serial communication lines respectively provided between the job control unit 250 and the printer control unit 230, and between the job control unit 350 and the printer control unit 330, both of which are already present in the respective stand-along image forming apparatuses, a LAN between the job control units 250 and 350 and a serial communication line between the printer control units 230 and 330 are newly provided. The communication between the job control units 250 and 350 is mainly used upon communication of image data therebetween. The communication between the printer control units 230 and 330 is mainly used upon communication of control information (paper position, device state, and the like) therebetween.

The job control unit 250 of the upstream device 20 includes a job executing unit 250*a* and a job dividing unit 250*b*. The job control unit 350 of the downstream device 30 includes a job executing unit 350*a*.

First, when a print job is received from the controller 24 at the job control unit 250 of the upstream device 20, the job dividing unit 250*b* divides the print job into an even page job and an odd page job, sends the even page job to the job executing unit 250*a* of the own device and the odd page job to the job executing unit 350*a* of the downstream device 30.

On the basis of the even page job received from the job dividing unit 250*b*, the job executing unit 250*a* of the upstream device 20 sends information necessary for the image formation to the printer control unit 230 to instruct job initiation.

On the basis of the odd page job received from the job dividing unit 250*b*, the job executing unit 350*a* of the downstream device 30 sends information necessary for the image formation to the printer control unit 330 to instruct job initiation.

When the job initiation instruction is received from the job control unit 250, the printer control unit 230 of the upstream device 20 causes the sheet of paper to be fed from the paper feed unit 10 for transfer paper, a resist unit (not shown) to correct misalignment of the sheet of paper, and the image forming unit 231 of the upstream device 20 to print an image on the first side. Thereafter, the printer control unit 230 causes a reverse unit (not shown) to reverse the sheet of paper and feed the same to the downstream device 30.

The printer control unit 330 of the downstream device 30 causes a resist unit (not shown) to correct the misalignment of the sheet of paper fed into the downstream device 30, and thereafter, causes the image forming unit 331 of the downstream device 30 to print the image on the other side of the sheet and discharges the same to the FNS 50.

Note that FIG. 4 is a view showing a case where the downstream device 30 is directly connected to the FNS 50 without having the paper feed unit 40 for cover paper insertion interposed therebetween.

(First Synchronization Timing: Upon Powering on)

Figure 5:
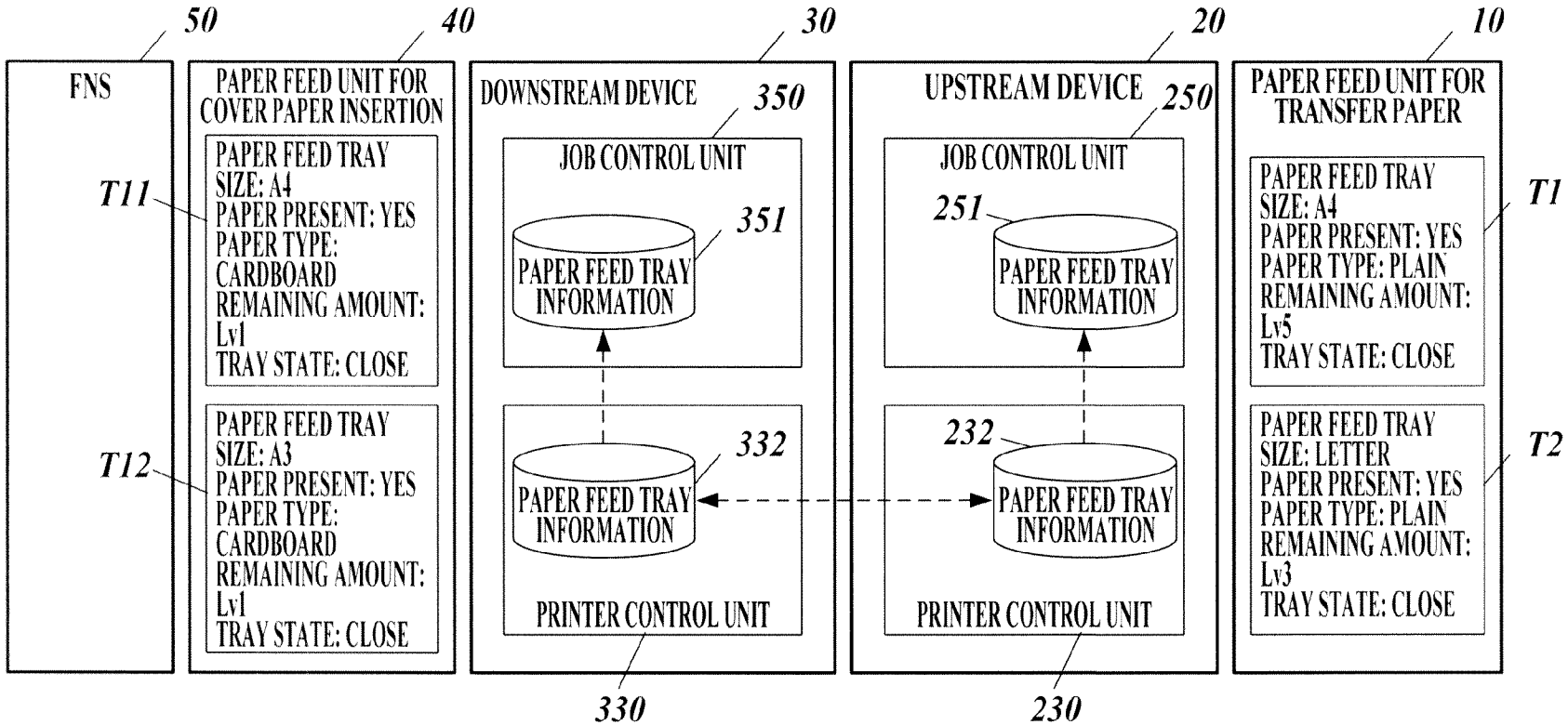

Next, a synchronization process of the paper feed tray information executed upon powering on is described referring to FIG. 5. As shown in FIG. 5, the paper feed unit 10 for transfer paper is connected to the upstream device 20 and the paper feed unit 40 for cover paper insertion is connected to the downstream device 30.

When the image forming system 100 is powered on, each of the printer control unit 230 of the upstream device 20 and the printer control unit 330 of the downstream device 30 detect which paper feed unit is connected to the own device, or a type of paper feed unit connected thereto. Here, the printer control unit 230 of the upstream device 20 detects that the paper feed unit 10 for transfer paper is connected to the own device, and causes the storage unit 232 to store the type of the detected paper feed unit. The printer control unit 330 of the downstream device 30 detects that the paper feed unit 40 for cover paper insertion is connected to the own device, and causes the storage unit 332 to store the type of the detected paper feed unit.

For example, the printer control unit 230 of the upstream device 20 inquires the paper feed unit 10 for transfer paper of a type of the paper feed unit and acquires information indicating the type of the paper feed unit from the paper feed unit 10 for transfer paper, in order to detect the type of the paper feed unit.

Likewise, the printer control unit 330 of the downstream device 20 inquires the paper feed unit 40 for cover paper insertion of a type of the paper feed unit and acquires information indicating the type of the paper feed unit from the paper feed unit 40 for cover paper insertion, in order to detect the type of the paper feed unit.

After the type of the paper feed unit connected to the own device is determined, each of the printer control unit 230 of the upstream device 20 and the printer control unit 330 of the downstream device 30 acquires information related to paper stored in respective paper feed trays in the paper feed unit (hereinafter, referred to as paper information) and information related to an opening/closing state of each of the paper feed trays (hereinafter, referred to as tray state information). The paper information includes size, presence/absence, remaining amount, paper type, weight and the like of the paper. The printer control unit 230 of the upstream device 20 causes the storage unit 232 to store the acquired paper information and tray state information, and the printer control unit 330 of the downstream device 30 causes the storage unit 332 to store the acquired paper information and tray state information.

For example, the printer control unit 230 of the upstream device 20 detects, for each of the paper feed trays T1 and T2 in the paper feed unit 10 for transfer paper, the size, presence/absence, paper type and remaining amount of the paper, and the opening/closing state of the paper feed tray. Regarding the remaining amount of the paper, the larger the number is, the greater the remaining amount is. Further, the opening/closing state of the paper feed tray indicates whether the paper feed tray is opened or closed. Similarly, the printer control unit 330 of the downstream device 30 detects, for each of the paper feed trays T11 and T12 in the paper feed unit 40 for cover paper insertion, the size, presence/absence, paper type and remaining amount of the paper, and the opening/closing state of the paper feed tray.

Specifically, the printer control unit 230 of the upstream device 20 detects the size of the paper stored in each of the paper feed trays, on the basis of an output signal from a paper size detection sensor provided in each of the paper feed trays in the paper feed unit 10 for transfer paper.

Further, the printer control unit 230 of the upstream device 20 detects the presence/absence and remaining amount of the paper stored in each of the paper feed trays, on the basis of an output signal from a paper detection sensor provided in each of the paper feed trays in the paper feed unit 10 for transfer paper.

Still further, the printer control unit 230 of the upstream device 20 inquires the paper feed unit 10 for transfer paper of the paper type and weight of the paper stored in each of the paper feed trays thereof, and acquires the paper type and weight of the paper corresponding to each of the paper feed trays from the paper feed unit 10 for transfer paper.

Yet still further, the printer control unit 230 of the upstream device 20 detects the opening/closing state of each of the paper feed trays, on the basis of an output signal from an opening/closing detection sensor provided in each of the paper feed trays in the paper feed tray 10 for transfer paper.

The printer control unit 330 of the downstream device 30 acquires paper tray information for each of paper feed trays in the paper feed unit 40 for cover paper insertion similarly to the above.

Next, the printer control unit 230 of the upstream device 20 sends the information acquired thereby to the printer control unit 330 of the downstream device 30, the information including the information indicating the type of the paper feed unit, the paper information, and the paper feed tray information including the tray state information (the paper feed tray information of the upstream device 20).

The printer control unit 330 of the downstream device 30 sends the information acquired thereby to the printer control unit 230 of the upstream device 20, the information including the information indicating the type of the paper feed unit, the paper information, and the paper feed tray information including the tray state information (the paper feed tray information of the downstream device 30).

When the paper feed tray information is received from the downstream device 30, the printer control unit 230 of the upstream device 20 causes the storage unit 232 to store the received paper feed tray information of the downstream device 30, combines the paper feed tray information of the upstream device 20 and the paper feed tray information of the downstream device 30 together to send the same to the job control unit 250.

When the paper feed tray information is received from the upstream device 20, the printer control unit 330 of the downstream device 30 causes the storage unit 332 to store the received paper feed tray information of the upstream device 20, combines the paper feed tray information of the downstream device 30 and the paper feed tray information of the upstream device 20 together to send the same to the job control unit 350.

The job control unit 250 of the upstream device 20 causes the non-volatile memory 251 to store the paper feed tray information of the upstream device 20 and the paper feed tray information of the downstream device 30 received from the printer control unit 230 of the upstream device 20.

The job control unit 350 of the downstream device 30 causes the non-volatile memory 351 to store the paper feed tray information of the upstream device 20 and the paper feed tray information of the downstream device 30 received from the printer control unit 330 of the downstream device 30.

Figure 6A:
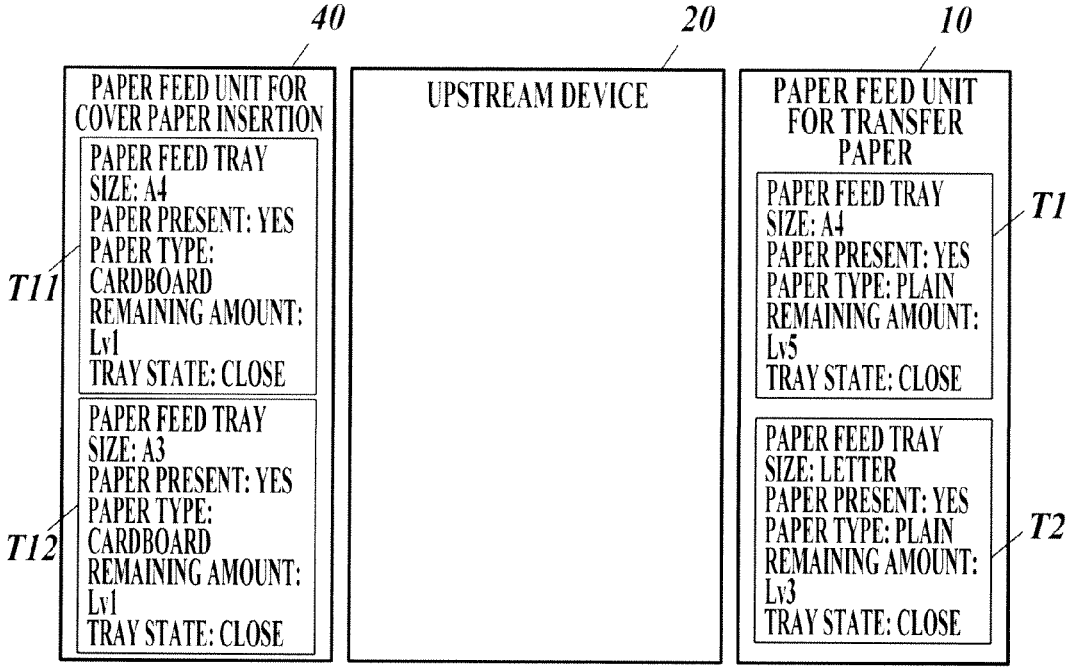
Figure 6B:
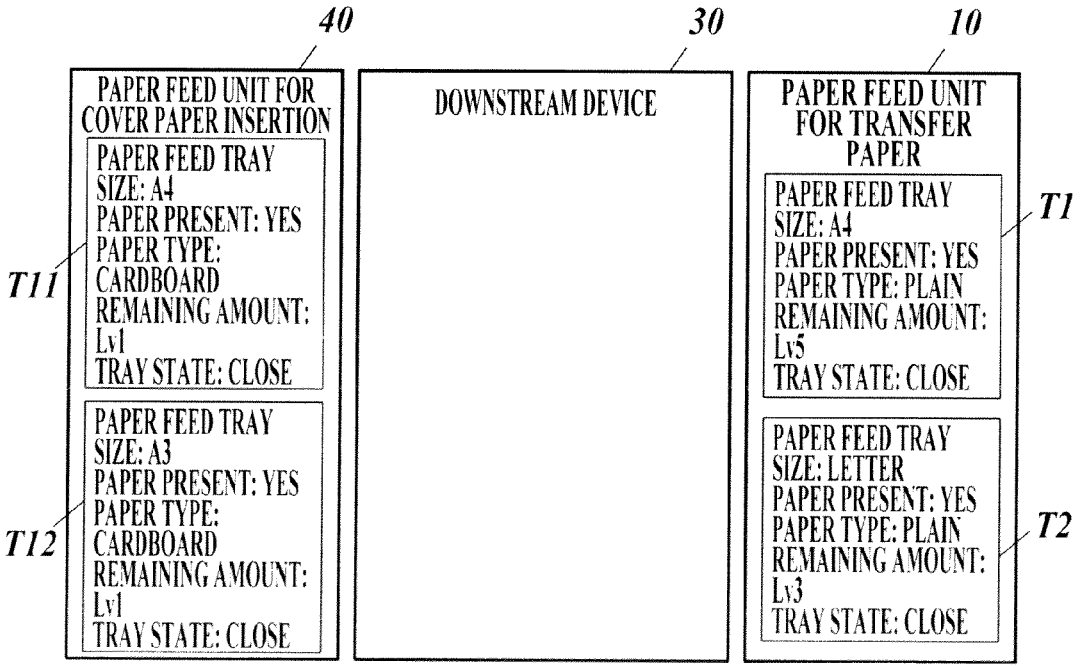

FIGS. 6A and 6B are views showing examples of the paper feed tray information that is recognized respectively in the job control unit 250 of the upstream device 20 and the job control unit 350 of the downstream device 30, after performing the synchronization of the paper feed tray information upon powering on.

The job control unit 250 of the upstream device 20 receives, from the printer control unit 230, the same paper feed tray information (the paper feed tray information of the upstream device 20 and the paper feed tray information of the downstream device 30) as the job control unit 350 of the downstream device 30; therefore, the job control units 250 and 350 recognize that the upstream device 20 and the downstream device 30 have the same tray configuration.

(Process Upon Job Reception)

Figure 7:
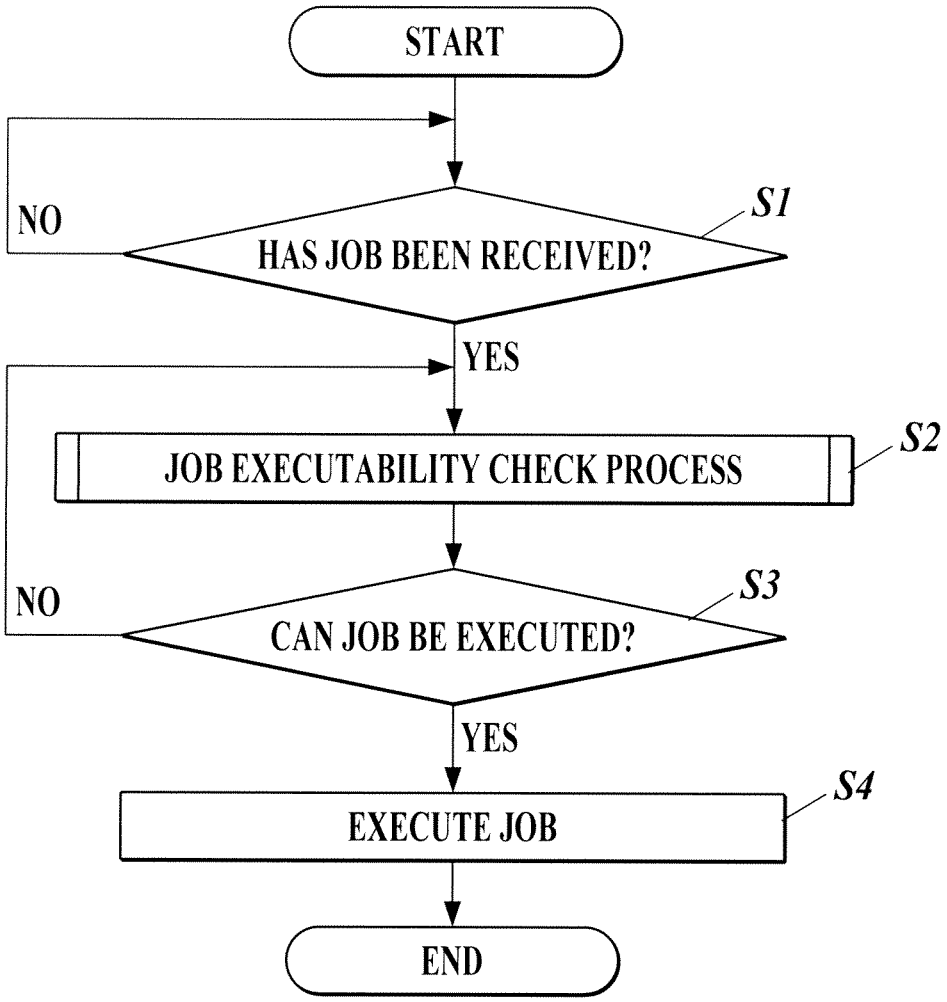
FIG. 7 is a flowchart showing a process upon job reception executed in the job control unit.

FIG. 7 is a flowchart showing a process upon job reception which is executed in each of the job control units 250 and 350. Here, the process in the job control unit 250 of the upstream device 20 is described; however, the process in the job control unit 350 of the downstream device 30 is executed similarly.

First, the job control unit 250 of the upstream device 20 determines whether a job has been received or not (step S1). Here, the job reception indicates reception of the above described "even page job" or "odd page job". In other words, the determination is made whether or not the job executing unit 250*a* of the job control unit 250 has received the job from the job dividing unit 250*b*, or whether or not the job executing unit 350*a* of the job control unit 350 has received the job from the job dividing unit 250*b*.

If the job has been received, (YES in step S1), the job control unit 250 of the upstream device 20 performs a job executability check process (step S2).

Figure 8:
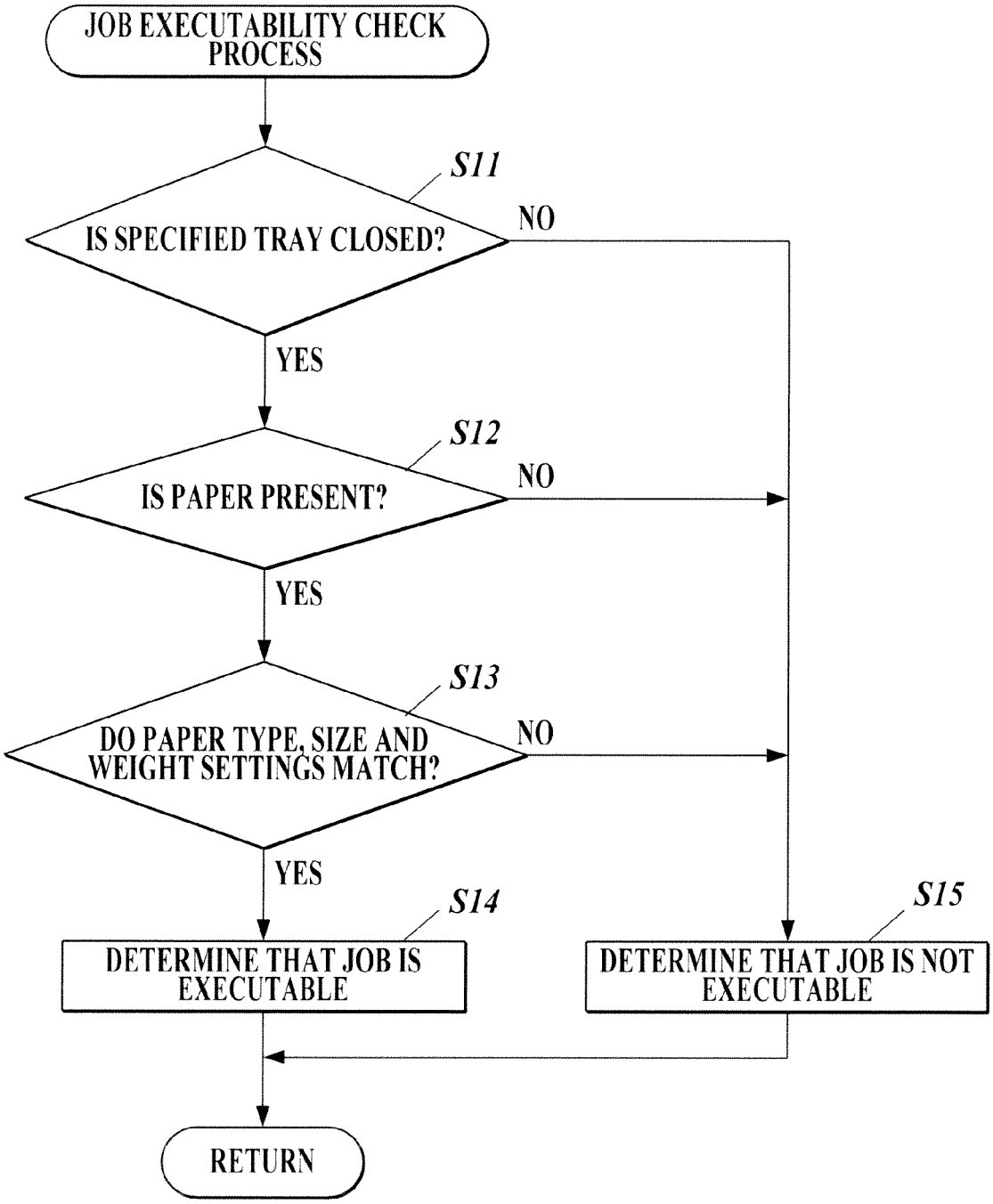
FIG. 8 is a flowchart showing a job executability check process.

Here, the job executability check process is described referring to FIG. 8.

The job control unit 250 of the upstream device 20 refers to, for the paper feed tray specified in the job, the tray state information included in the paper tray information stored in the non-volatile memory 251 and determines whether the specified paper feed tray is closed or not (step S11).

If the specified paper feed tray is closed (YES in step S11), the job control unit 250 of the upstream device 20 refers to, for the paper feed tray specified in the job, information indicating presence of the paper which is included in the paper feed tray information stored in the non-volatile memory 251, and determines whether the paper is present or not in the specified paper feed tray (step S12).

If the specified paper feed tray has the paper therein (YES in step S12), the job control unit 250 of the upstream device 20 refers to, for the paper feed tray specified in the job, information indicating the paper type, size and weight of the paper which is included in the paper feed tray information stored in the non-volatile memory 251, and determines whether the paper type, size and weight of the paper specified in the job matches or not with those for the specified paper feed tray stored in the non-volatile memory 251 (step S13).

If the paper type, size and weight of the paper specified in the job matches with those for the specified paper feed tray (YES in step S13), the job control unit 250 of the upstream device 20 determines that the job is executable (step S14).

If the specified paper feed tray is not closed in step S11 (NO in step S11), the specified paper feed tray has no paper therein in step S12 (NO in step S12), or the paper type, size and weight of the paper for the specified paper feed tray does not match with those specified in the job in step S13 (NO in step S13), the job control unit 250 of the upstream device determines that the job is not executable (step S15) Here, if the specified paper feed tray is not closed (NO in step S11), the job control unit 250 of the upstream device 20 instructs the operation display control unit 220 to display a message to close the specified paper feed tray. According to this instruction, the operation display control unit 220 causes the LCD 221 to display the message to close the specified paper feed tray.

If the specified paper feed tray has no paper therein (NO in step S12), or when the paper type, size and weight of the paper specified in the job does not match with those for the specified paper feed tray (NO in step S13), the job control unit 250 of the upstream device 20 instructs the operation display control unit 220 to display a message to set correct paper. According to this instruction, the operation display control unit 220 causes the LCD 221 to display the message prompting to set the correct paper.

Back to FIG. 7, when it is determined as a result of the job executability check process that the job is not executable (NO in step S3), the process returns to step S2.

When it is determined as a result of the job executability check process that the job is executable (YES in step S3), the job control unit 250 of the upstream device 20 sends the job initiation instruction to the printer control unit 230 of the upstream device 20 and causes the job to be executed (step S4).

The process upon job reception thus ends. The process upon job reception is controlled in the same way as in a case of using the upstream device 20 and the downstream device 30 separately as stand-alone devices.

As described above, according to the first embodiment, the pieces of the paper feed tray information are mutually communicated between the upstream device 20 and the downstream device 30 upon powering on; therefore, the information related to the paper feed trays connected to the respective image forming apparatuses (the upstream device 20 and the downstream device 30) can be shared in the image forming system of the tandem configuration, and the construction of the image forming system can be simplified.

Upon powering on, the printer control unit 230 of the upstream device 20 and the printer control unit 330 of the downstream device 30 mutually communicate to inform the paper feed tray information of the own devices and send the paper feed tray information of the upstream device 20 and the paper feed tray information of the downstream device 30 to the job control units 250 and 350 of the own devices; therefore, the job control units 250 and 350 only need to perform the same process upon job reception (see FIGS. 7 and 8) as in the stand-alone use. Accordingly, the job control units 250 and 350 can utilize the job control program for the stand-alone use, suppressing software development man-hours upon constructing the image forming apparatus of the tandem configuration to the minimum. In other words, the job control programs for the upstream device 20 and the downstream device 30 do not need to be made different but can be made common, achieving the image forming system to be constructed efficiently.

Moreover, regarding a special sequence such as an empty tray switch, an additional operation is not particularly required because the paper feed tray information is synchronized, and the job control program of the stand-alone use can be applied to the system.

In addition, in the first embodiment, the description is made of the case in which the paper feed tray information of the paper feed unit 10 for transfer paper and the paper feed tray information of the paper feed unit 40 for cover paper insertion are mutually informed between the upstream device 20 and the downstream device 30; however, the paper feed tray information provided in the upstream device 20 itself and the paper feed tray information provided in the downstream device 30 itself can be mutually informed therebetween.

Second Embodiment

Next, a second embodiment applying the present invention is described.

Because an image forming system of the second embodiment has a similar configuration to the image forming system 100 described in the first embodiment, FIGS. 1 to 4 are referred to as an aid and illustration and description of the configuration thereof are omitted. Hereinafter, configurations and processes characteristic to the second embodiment are described.

In the upstream device 20, when the paper feed tray information of the upstream device 20 stored in the non-volatile memory 251 or the storage unit 232 is changed, the job control unit 250 or the printer control unit 230 (control units of the upstream device 20) sends at least the changed pieces of information from among the paper feed tray information of the upstream device 20 to the downstream device 30.

In the downstream device 30, when the paper feed tray information of the downstream device 30 stored in the non-volatile memory 351 or the storage unit 332 is changed, the job control unit 350 or the printer control unit 330 (control units of the downstream device 30) sends at least the changed pieces of information from among the paper feed tray information of the downstream device 30 to the upstream device 20.

Specifically, in the upstream device 20, when the paper feed tray information of the upstream device 20 stored in the storage unit 232 is changed, the printer control unit 230 of the upstream device 20 sends at least the changed pieces of information from among the paper feed tray information of the upstream device 20 to the job control unit 250 of the upstream device 20 and the printer control unit 330 of the downstream device 30.

The printer control unit 330 of the downstream device 30 receives the changed pieces of information from the printer control unit 230 of the upstream device 20 and sends the same to the job control unit 350 of the downstream device 30.

In the downstream device 30, when the paper feed tray information of the downstream device 30 stored in the storage unit 332 is changed, the printer control unit 330 of the downstream device 30 sends at least the changed pieces of information from among the paper feed tray information of the downstream device 30 to the job control unit 350 of the downstream device 30 and the printer control unit 230 of the upstream device 20.

The printer control unit 230 of the upstream device 20 receives the changed pieces of information from the printer control unit 330 of the downstream device 30 and sends the same to the job control unit 250 of the upstream device 20.

(Second Synchronization Timing: Upon Tray Opening/Closing)

Figure 9:
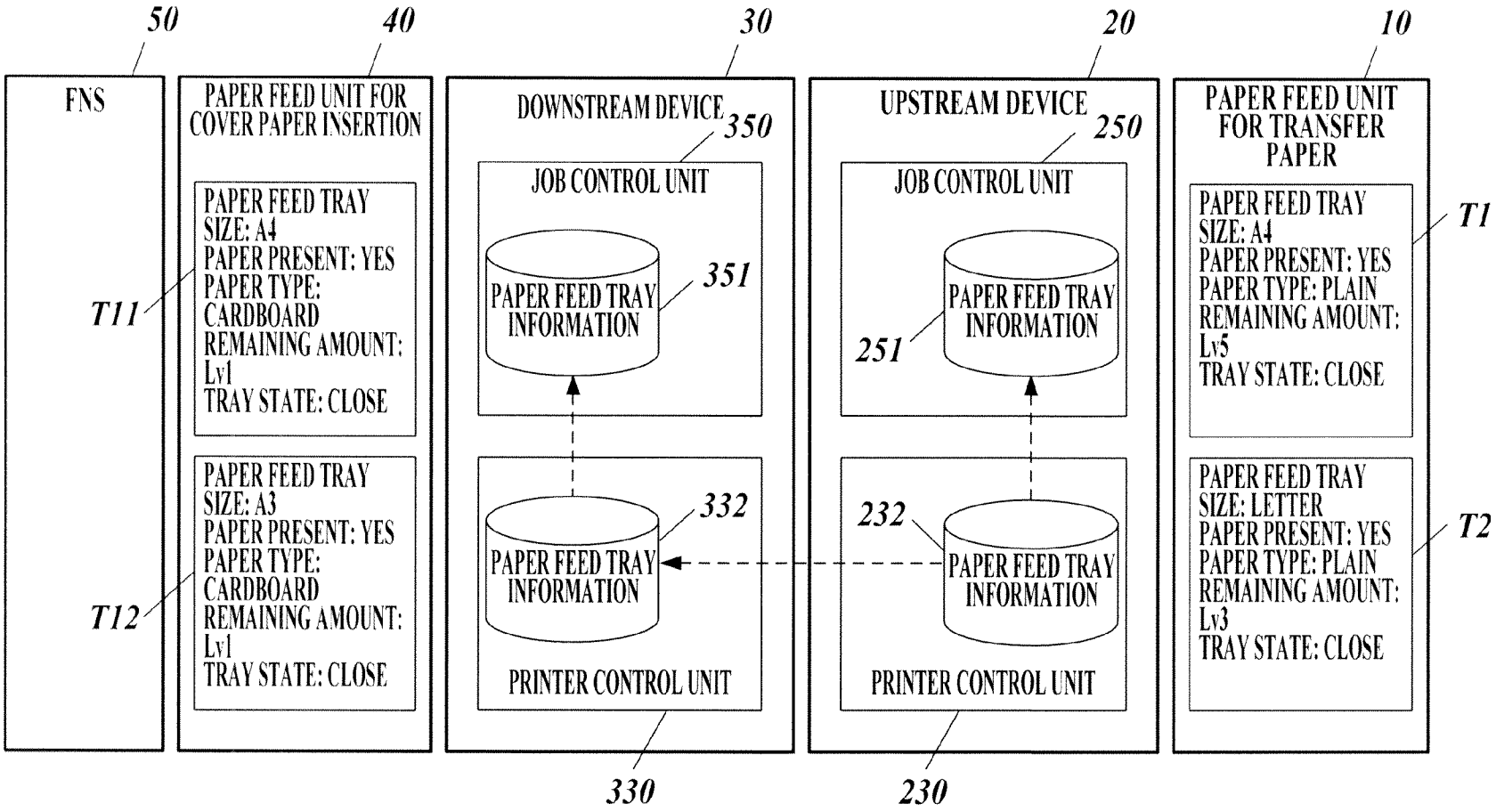
FIG. 9 is a view for explaining a synchronization process of the paper feed tray information executed upon opening and closing a paper feed tray.

Next, a synchronization process of the paper feed tray information executed upon opening/closing the paper feed tray T1 of the paper feed unit 10 for transfer paper is described referring to FIG. 9.

Here, a description is made of the synchronization of the paper feed tray information in the paper feed unit 10 for transfer paper connected to the upstream device 20 in a case where a user opens the paper feed tray T1 (Tray Opened), changes the paper and closes the tray (Tray Closed).

When the opening of the paper feed tray T1 is detected, the printer control unit 230 of the upstream device 20 rewrites the tray state information of the paper feed tray T1 included in the paper feed tray information stored in the storage unit 232, and sends the tray state information (Tray Opened) of the paper feed tray T1 to the job control unit 250 of the upstream device 20 and the printer control unit 330 of the downstream device 30.

When the tray state information of the paper feed tray T1 (Tray Opened) is received from the printer control unit 230 of the upstream device 20, the printer control unit 330 of the downstream device 30 rewrites the tray state information of the paper feed tray T1 included in the paper feed tray information stored in the storage unit 332, and sends the tray state information of the paper feed tray T1 (Tray Opened) to the job control unit 350 of the downstream device 30.

The job control unit 250 of the upstream device 20 causes the non-volatile memory 251 to store the tray state information (Tray Opened) received from the printer control unit 230 of the upstream device 20.

The job control unit 350 of the downstream device 30 causes the non-volatile memory 351 to store the tray state information (Tray Opened) received from the printer control unit 330 of the downstream device 30.

Figure 10A:
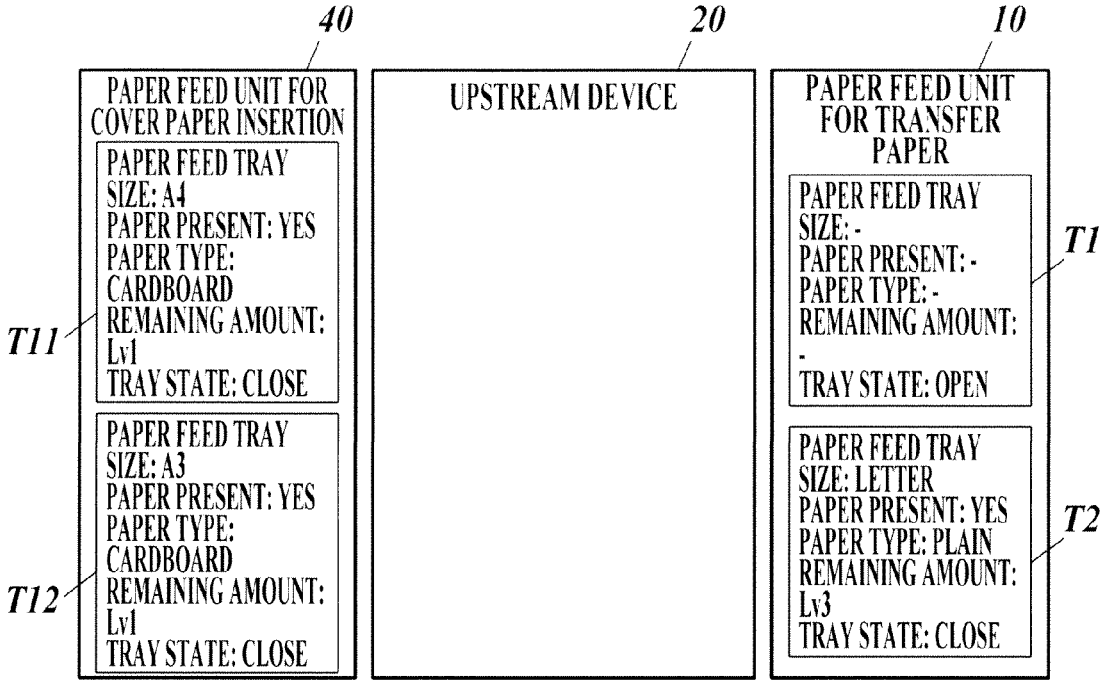
FIG. 10A is a view showing an example of the paper feed tray information that is recognized in the job control unit of the upstream device when the paper feed tray is opened.
Figure 10B:
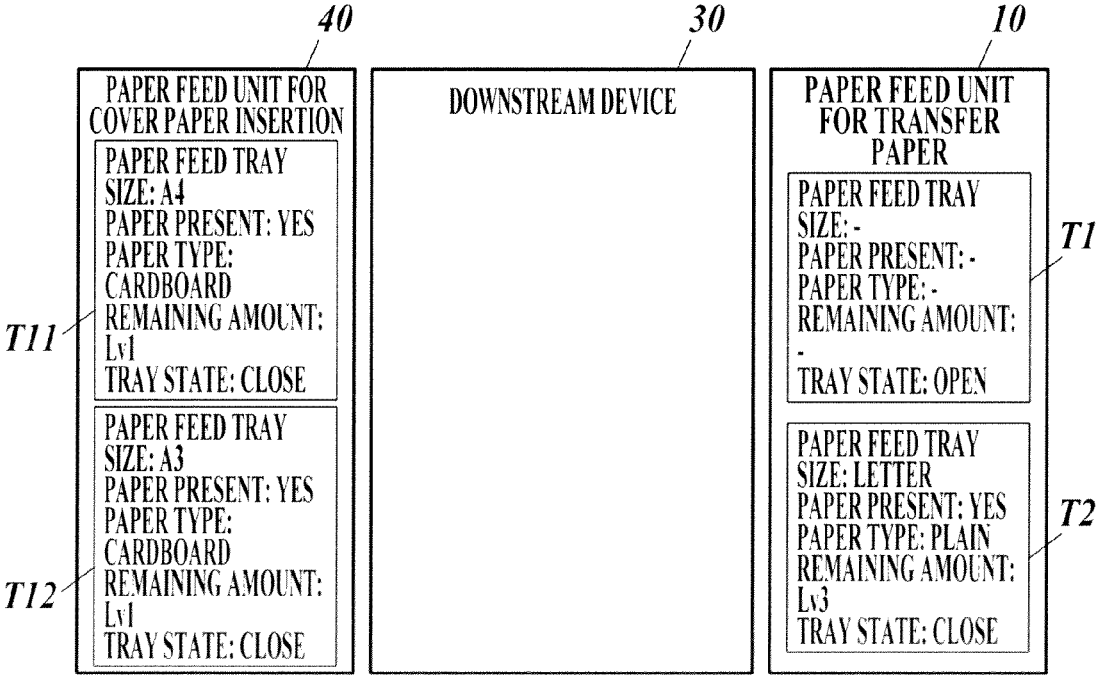
FIG. 10B is a view showing an example of the paper feed tray information that is recognized in the job control unit of the downstream device when the paper feed tray is opened.

FIGS. 10A and 10B show examples of the paper feed tray information recognized in the job control unit 250 of the upstream device 20 and the job control unit 350 of the downstream device 30, respectively, when the paper feed tray T1 is opened. Because the pieces of the tray state information in the upstream device 20 and the downstream device 30 are synchronized, the opened state of the paper feed tray T1 of the transfer paper feed tray 10 is recognized by the job control unit 350 of the downstream device 30 as well.

Next, the user sets the sheets of postcard-sized paper in the paper feed tray T1 of the paper feed unit 10 for transfer paper and closes the paper feed tray T1.

When the closing of the paper feed tray T1 of the paper feed unit 10 for transfer paper is detected, the printer control unit 230 of the upstream device 20 rewrites the tray state information of the paper feed tray T1 included in the paper feed tray information stored in the storage unit 232, and sends the tray state information of the paper feed tray T1 (Tray Closed) to the job control unit 250 of the upstream device 20 and the printer control unit 330 of the downstream device 30.

When the tray state information of the paper feed tray T1 (Tray Closed) is received from the printer control unit of the upstream device 20, the printer control unit 330 of the downstream device 30 rewrites the tray state information of the paper feed tray T1 included in the paper feed tray information stored in the storage unit 332, and sends the tray state information of the paper feed tray T1 (Tray Closed) to the job control unit 350 of the downstream device 30.

The job control unit 250 of the upstream device 20 causes the non-volatile memory 251 to store the tray state information (Tray Closed) received from the printer control unit 230 of the upstream device 20.

The job control unit 350 of the downstream device 30 causes the non-volatile memory 351 to store the tray state information (Tray Closed) received from the printer control unit 330 of the downstream device 30.

Next, the printer control unit 230 of the upstream device 20 acquires the paper information such as the size and remaining amount of the paper set in the paper feed tray T1 from the paper feed unit 10 for transfer paper, causes the storage unit 232 to store the acquired paper information, and sends the paper information to the job control unit 250 of the upstream device 20 and the printer control unit 330 of the downstream device 30.

When the paper information is received from the printer control unit 230 of the upstream device 20, the printer control unit 330 of the downstream device 30 causes the storage unit 332 to store the received paper information and sends the paper information to the job control unit 350 of the downstream device 30.

The job control unit 250 of the upstream device 20 causes the non-volatile memory 251 to store the paper information received from the printer control unit 230 of the upstream device 20.

The job control unit 350 of the downstream device 30 causes the non-volatile memory 351 to store the paper information received from the printer control unit 330 of the downstream device 30.

Figure 11A:
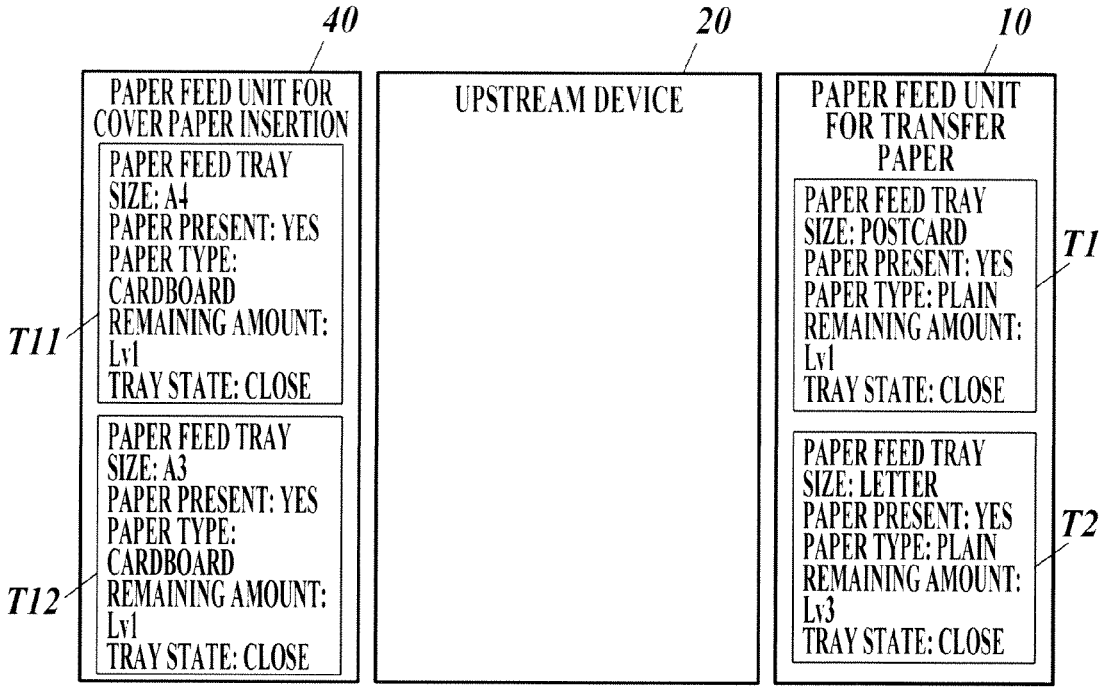
FIG. 11A is a view showing an example of the paper feed tray information that is recognized in the job control unit of the upstream device when the paper feed tray is closed.
Figure 11B:
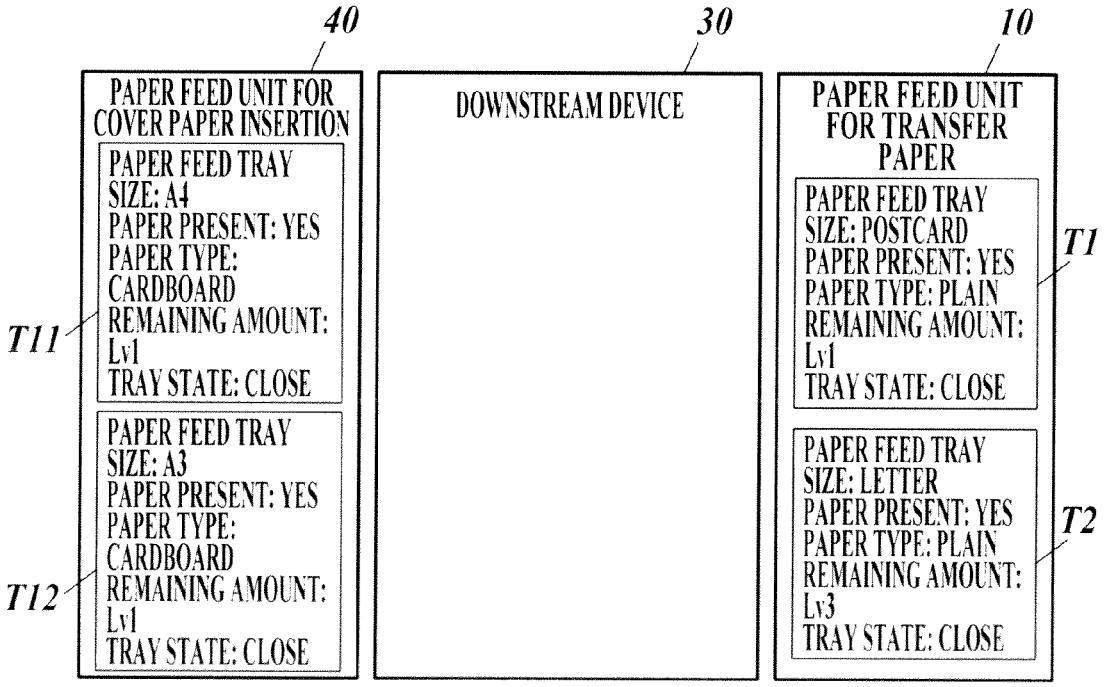
FIG. 11B is a view showing an example of the paper feed tray information that is recognized in the job control unit of the downstream device when the paper feed tray is closed.

FIGS. 11A and 11B show examples of the paper feed tray information recognized in the job control unit 250 of the upstream device 20 and the job control unit 350 of the downstream device 30, respectively, when the paper feed tray T1 is closed.

Because the pieces of the paper feed tray information (tray state information, paper information, and the like) received at the job control unit 250 from the printer control unit 230 in the upstream device 20 and the printer control unit 330 from the printer control unit 330 in the downstream device 30, respectively, become the same, it is recognized in the job control units 250 and 350 as if the same tray operations are performed in the upstream device 20 and the downstream device 30.

The process upon job reception which is executed by each of the job control units 250 and 350 is similar to the process described in the first embodiment (see FIGS. 7 and 8), so the description is omitted.

As described above, according to the second embodiment, the changed pieces of information are sent from the upstream device 20 to the downstream device 30 when the paper feed tray information (tray state information and paper information) of the upstream device 20 is changed; therefore, the information related to the paper feed trays connected to the respective image forming apparatuses (the upstream device 20 and the downstream device 30) can be shared in the image forming system of the tandem configuration, and the construction of the image forming system can be simplified.

When the paper feed tray is opened/closed or the paper to be stored in the paper feed tray is changed, the printer control unit 230 of the upstream device 20 sends the changed pieces of information from among the paper feed tray information to the printer control unit 330 of the downstream device 30 and thereafter, the printer control units 230 and 330 of the respective devices send the changed pieces of information to the job control units 250 and 350 of the own devices; therefore, the job control units 250 and 350 only need to perform the same process upon job reception (see FIGS. 7 and 8) as in the stand-alone use. Accordingly, the job control units 250 and 350 can utilize the job control program for the stand-alone use, suppressing software development man-hours upon constructing the image forming apparatus of the tandem configuration to the minimum. In other words, the job control programs for the upstream device 20 and the downstream device 30 do not need to be made different but can be made common, achieving the image forming system to be constructed efficiently.

In addition, in the second synchronization timing, the description is made of the case in which the change of the paper feed tray information of the paper feed unit 10 for transfer paper is informed from the upstream device 20 to the downstream device 30; however, the paper feed tray information provided in the upstream device 20 itself, the paper feed tray information provided in the downstream device 30 itself, the paper feed tray information of the paper feed unit 40 for cover paper insertion and can be mutually informed therebetween.

Third Embodiment

Next, a third embodiment applying the present invention is described.

Because an image forming system of the third embodiment has a similar configuration to the image forming system 100 described in the first embodiment, FIGS. 1 to 4 are referred to as an aid and illustration and description of the configuration thereof are omitted. Hereinafter, configurations and processes characteristic to the third embodiment are described.

In the upstream device 20, when the paper feed tray information of the upstream device 20 stored in the non-volatile memory 251 or the storage unit 232 is changed, the job control unit 250 or the printer control unit 230 (control units of the upstream device 20) sends at least the changed pieces of information from among the paper feed tray information of the upstream device 20 to the downstream device 30.

Specifically, in the upstream device 20, when the paper feed tray information of the upstream device 20 stored in the non-volatile memory 251 is changed from the operation section 22, the job control unit 250 of the upstream device 20 sends at least the changed pieces of information from among the paper feed tray information to the printer control unit 230 of the upstream device 20 and the job control unit 350 of the downstream device 30.

The job control unit 350 of the downstream device 30 receives the changed pieces of information from the job control unit 250 of the upstream device 20 and sends the changed pieces of information thus received to the printer control unit 330 of the downstream device 30.

(Third Synchronization Timing: Upon Changing Paper Type/Weight Setting)

Figure 12:
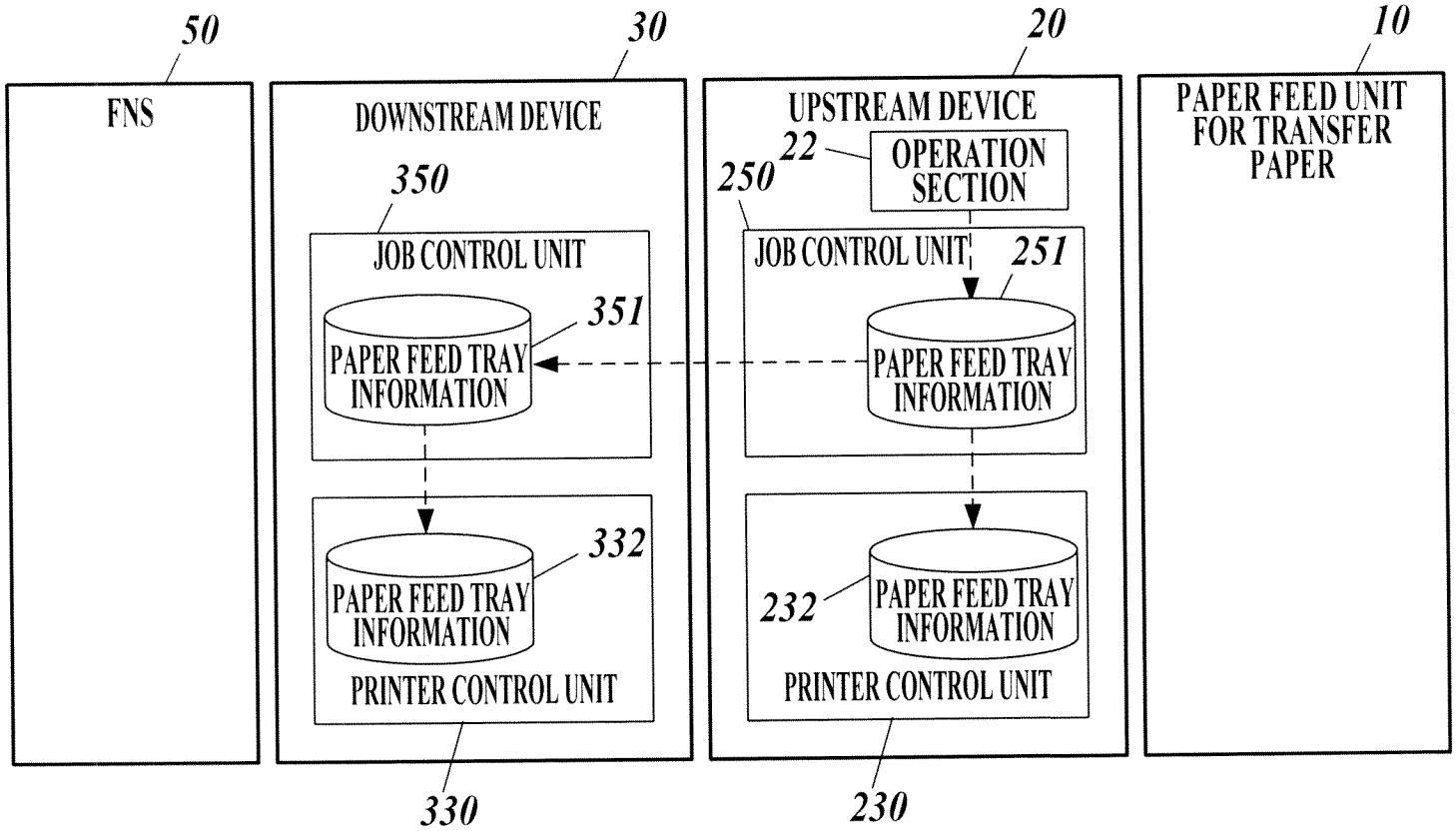
FIG. 12 is a view for explaining a synchronization process of the paper feed tray information when a paper type/weight setting of the paper feed tray is changed.

Next, referring to FIG. 12, a synchronization process of the paper feed tray is described, when a user changes a paper type/weight setting of one paper feed tray (for example, the paper feed tray T1) in the paper feed unit 10 for transfer paper connected to the upstream device 20.

When the user changes the paper type/weight setting of the paper feed tray T1 from the operation section 22, a setting value for the changed paper type/weight is sent from the operation display control unit 220 to the job control unit 250.

When the change of the paper type/weight setting is detected, the job control unit 250 of the upstream device 20 rewrites the paper information (paper type/weight) of the paper feed tray T1 included in the paper feed tray information stored in the non-volatile memory 251, and sends the paper information to the job control unit 350 of the downstream device 30.

When the changed paper information is received from the job control unit 250 of the upstream device 20, the job control unit 350 of the downstream device 30 causes the non-volatile memory 351 to store the changed paper information.

The job control unit 250 of the upstream device 20 sends the changed paper information (paper type/weight) to the printer control unit 230 of the upstream device 20, and the printer control unit 230 of the upstream device 20 causes the storage unit 232 to store the changed paper information.

The job control unit 350 of the downstream device 30 sends the changed paper information (paper type/weight) to the printer control unit 330 of the downstream device 30, and the printer control unit 330 of the downstream device 30 causes the storage unit 332 to store the changed paper information.

As described above, the job control unit 250 that receives the information from the operation section 22 synchronizes the information between itself and the job control unit 350, regarding data such as paper type/weight and the like set from the operation section 22.

The process upon job reception which is executed by each of the job control units 250 and 350 is similar to the process described in the first embodiment (see FIGS. 7 and 8), so the description is omitted.

As described above, according to the third embodiment, the changed pieces of information are sent from the upstream device 20 to the downstream device 30 when the paper feed tray information of the upstream device 20 is changed from the operation section 22; therefore, the information related to the paper feed trays connected to the respective image forming apparatuses (the upstream device 20 and the downstream device 30) can be shared in the image forming system of the tandem configuration, and the construction of the image forming system can be simplified.

When the paper type/weight setting is changed from the operation section 22, the job control unit 250 of the upstream device 20 sends the changed pieces of information from among the paper feed tray information to the job control unit 350 of the downstream device 30 and thereafter, the job control units 250 and 350 of the respective devices send the changed pieces of information to the printer control units 230 and 330 of the own devices; therefore, the job control units 250 and 350 only need to perform the same process upon job reception (see FIGS. 7 and 8) as in the stand-alone use. Also, the similar process is executed as in the conventional case, when the job control units 250 and 350 respectively sends the changed pieces of information changed from the operation section 22 to the printer control units 230 and 330 of the own devices. Accordingly, the job control units 250 and 350 can utilize the job control program for the stand-alone use, suppressing software development man-hours upon constructing the image forming apparatus of the tandem configuration to the minimum. In other words, the job control programs for the upstream device 20 and the downstream device 30 do not need to be made different but can be made common, achieving the image forming system to be constructed efficiently.

In addition, in the third embodiment, the description is made of the case in which the paper feed tray information of the upstream device is changed from the operation section 22 provided in the upstream device 20. However, in a case of changing the paper feed tray information of the downstream device 30 from the operation section 22, a configuration may be applied in which: the job control unit 350 of the downstream device 30 sends at least the changed pieces of information from among the paper feed tray information of the downstream device 30 to the job control unit 250 of the upstream device 20; and the job control units 250 and 350 of the respective devices send the changed pieces of information to the printer control units 230 and 330 of the own devices.

Fourth Embodiment

Next, a fourth embodiment applying the present invention is described.

Because an image forming system of the fourth embodiment has a similar configuration to the image forming system 100 described in the first embodiment, FIGS. 1 to 4 are referred to as an aid and illustration and description of the configuration thereof are omitted. Hereinafter, configurations and processes characteristic to the third embodiment are described.

Some of the adjustment values stored in each of the non-volatile memory 251 and the storage unit 232 of the upstream device 20 and in each of the non-volatile memory 351 and the storage unit 332 of the downstream device 30 include information for a front side of the paper and information for a reverse side of the paper. For example, there are a transfer current adjustment value, magnification of the image, fixing temperature, and the like.

Regarding the adjustment values which are different in the respective pieces of information for the front side and the reverse side of the paper, the printer control unit 230 of the upstream device 20 reads out the information for the front side of the paper from among the adjustment values (for front side/for reverse side) stored in the storage unit 232, and causes the image forming unit 231 of the upstream device 20 to perform the image formation on the front side of the paper.

In addition, storage unit 232 has information stored therein indicating that the upstream device 20 is the image forming apparatus for printing the front side, and by referring to this information, the printer control unit 230 recognizes that the own device is the upstream device 20.

Regarding the adjustment values which are different in the respective pieces of information for the front side and the reverse side of the paper, the printer control unit 330 of the downstream device 30 reads out the information for the reverse side of the paper from among the adjustment values (for front side/for reverse side) stored in the storage unit 332, and causes the image forming unit 331 of the downstream device 30 to perform the image formation on the reverse side of the paper.

In addition, storage unit 332 has information stored therein indicating that the downstream device 30 is the image forming apparatus for printing the reverse side, and by referring to this information, the printer control unit 330 recognizes that the own device is the downstream device 30.

(Fourth Synchronization Timing: Upon Changing Adjustment Value Setting)

Figure 13:
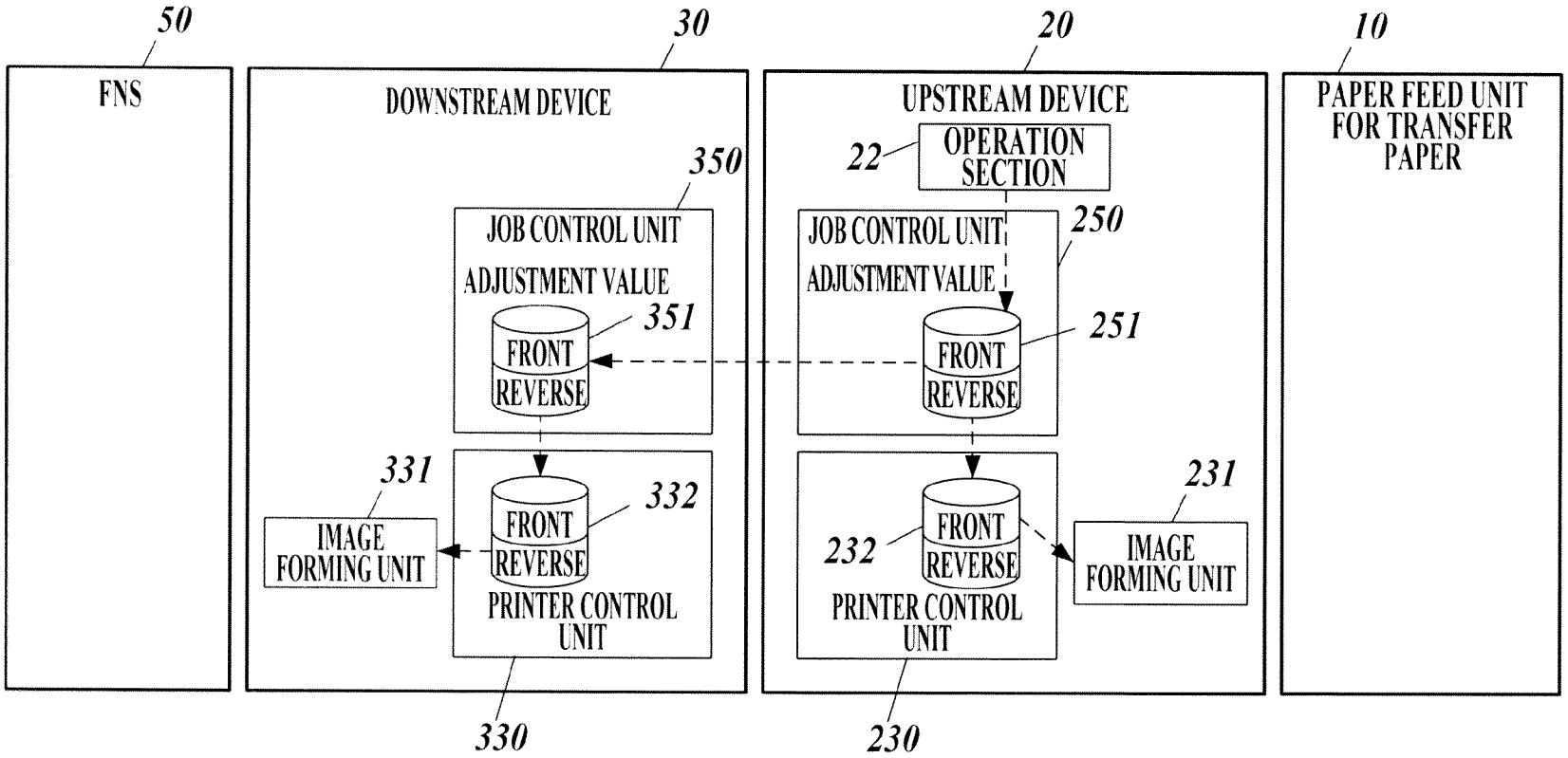
FIG. 13 is a view for explaining a synchronization process of the paper feed tray information when an adjustment value for the paper feed tray is changed and a usage method of the adjustment value.

Next, referring to FIG. 13, a description is made on a synchronization process of the paper feed tray when a user changes an adjustment value for paper in one paper feed tray (for example, the paper feed tray T1) in the paper feed unit 10 for transfer paper connected to the upstream device 20, and usage of the adjustment value. Here, a case of changing the transfer current adjustment value (for front side/for reverse side) is described.

When the user changes from the operation section 22 the transfer current adjustment value (for front side/for reverse side) for the paper in the paper feed tray T1, the changed transfer current adjustment value is sent from the operation display control unit 220 to the job control unit 250.

The job control unit 250 of the upstream device 20 rewrites the transfer current adjustment value (for front side/for reverse side) for the paper feed tray T1 included in the paper feed tray information stored in the non-volatile memory 251, and sends both of the transfer current adjustment values respectively included in the pieces of information for the front side and the reverse side to the job control unit 350 of the downstream device 30.

When the changed transfer current adjustment value (for front side/for reverse side) is received from the job control unit 250 of the upstream device 20, the job control unit 350 of the downstream device 30 causes the non-volatile memory 351 to store the changed transfer current adjustment value.

The job control unit 250 of the upstream device 20 sends both of the transfer current adjustment values respectively included in the pieces of information for the front side and the reverse side to the printer control unit 230 of the upstream device 20. The printer control unit 230 of the upstream device 20 causes the storage unit 232 to store both of the transfer current adjustment values respectively included in the pieces of information for the front side and the reverse side.

The job control unit 350 of the downstream device 30 sends both of the transfer current adjustment values respectively included in the pieces of information for the front side and the reverse side to the printer control unit 330 of the downstream device 30. The printer control unit 330 of the upstream device 30 causes the storage unit 332 to store both of the transfer current adjustment values respectively included in the pieces of information for the front side and the reverse side.

In the print operation, the printer control unit 230 of the upstream device 20 reads out the information for the front side from among the transfer current adjustment values stored in the storage unit 232, and causes the image forming unit 231 to perform the image formation on the front side of the paper on the basis of the information for the front side thus read out.

On the other hand, the printer control unit 330 of the downstream device 30 reads out the information for the reverse side from among the transfer current adjustment values stored in the storage unit 332, and causes the image forming unit 331 to perform the image formation on the reverse side of the paper on the basis of the information for the reverse side thus read out.

Each of the printer control units 230 and 330 recognizes whether the own device is the upstream device 20 or the downstream device 30, and the image formation is performed by using the information on the front side if the own device is the upstream device 20 and using the information on the reverse side if the own device is the downstream device 30. Accordingly, the job control units 230 and 350 can execute the job operations by the job control programs used in the stand-alone use, without considering the tandem configuration in which the upstream device 20 and the downstream device 30 are provided in a serial manner.

The process upon job reception which is executed by each of the job control units 250 and 350 is similar to the process described in the first embodiment (see FIGS. 7 and 8), so the description is omitted.

As described above, according to the fourth embodiment, the changed pieces of information are sent from the upstream device 20 to the downstream device 30 when the adjustment values set separately for the front side and the reverse side of the paper are changed from the operation section 22; therefore, the information related to the paper feed trays connected to the respective image forming apparatuses (the upstream device 20 and the downstream device 30) can be shared in the image forming system of the tandem configuration, and the construction of the image forming system can be simplified.

When the adjustment values such as the transfer current adjustment value are changed from the operation section 22, the job control unit 250 of the upstream device 20 sends the changed pieces of information from among the paper feed tray information to the job control unit 350 of the downstream device 30 and thereafter, the job control units 250 and 350 of the respective devices send the changed pieces of information to the printer control units 230 and 330 of the own devices; therefore, the job control units 250 and 350 only need to perform the same process upon job reception (see FIGS. 7 and 8) as in the stand-alone use. Also, the similar process is executed as in the conventional case, when the job control units 250 and 350 respectively sends the changed pieces of information changed from the operation section 22 to the printer control units 230 and 330 of the own devices. Accordingly, the job control units 250 and 350 can utilize the job control program for the stand-alone use, suppressing software development man-hours upon constructing the image forming apparatus of the tandem configuration to the minimum. In other words, the job control programs for the upstream device 20 and the downstream device 30 do not need to be made different but can be made common, achieving the image forming system to be constructed efficiently.

In addition, in the fourth embodiment, the description is made of the case in which the adjustment value is changed from the operation section 22 provided in the upstream device 20. However, in a case of changing the adjustment value stored in the downstream device 30, a configuration may be applied in which: the job control unit 350 of the downstream device 30 sends at least the changed pieces of information from among the paper feed tray information of the downstream device 30 to the job control unit 250 of the upstream device 20; and the job control units 250 and 350 of the respective devices send the changed pieces of information to the printer control units 230 and 330 of the own devices.

The descriptions made in the above embodiments are only examples of an image forming system according to the present invention, and the present invention is not limited to the above embodiments. The embodiments can be altered, in detailed configurations and operations of the devices configuring the system, without departing from the object of the present invention.

For example, the synchronization timing of the paper feed tray information between the upstream device 20 and the downstream device 30 is not limited to the examples in the above embodiments. However, instead of this, the first to fourth synchronization timings shown in the above respective embodiments can be combined to synchronize the paper feed tray information between the upstream device 20 and the downstream device 30.

Further, in each of the above embodiments, in order to utilize the job control program that accounts for a substantial fraction among the control programs of the image forming apparatus, depending on the type of information, the synchronization between the printer control unit 230 and the printer control unit 330 and the synchronization between the job control unit 250 and the job control unit 350 are separately described. However, the synchronization may be made between the printer control unit 230 and the printer control unit 330 for all types of information, and the job control programs may share as much program as possible with the one for the stand-alone use. Or, conversely, the synchronization may be made between the job control program 250 and the job control program 350 for all types of information, and the printer control programs may share the program with the one for the stand-alone use.

Further, in each of the above embodiments, the case is described in which two image forming apparatuses are connected, but a case may be applied in which three or more image forming apparatuses are connected in series in the paper conveying direction.

The entire disclosure of a Japanese Patent Application No. 2012-092596, filed on Apr. 16, 2012, including specifications, claims, drawings and summaries are incorporated herein by reference in their entirety.

What is claimed is:

1. An image forming system, comprising:

a plurality of image forming apparatuses connected in series along a paper conveying direction, wherein an image forming apparatus provided upstream in the paper conveying direction among the plurality of image forming apparatuses prints one side of a sheet of paper and an image forming apparatus provided downstream with respect to the upstream image forming apparatus prints the other side of the sheet of paper, wherein each of the upstream and downstream image forming apparatuses comprises:

an image forming unit;

a storage unit; and a control unit, wherein at least one of the upstream and downstream image forming apparatuses makes the storage unit of the own image forming apparatus store a first information related to a paper feed tray of the own image forming apparatus, the at least one image forming apparatus receives a second information related to a paper feed tray of the other image forming apparatus from the other image forming apparatus, in the at least one image forming apparatus, the control unit makes the storage unit store the second information, and in the at least one image forming apparatus, the control unit makes the image forming unit perform image formation based on the first and second information stored in the storage unit.

2. The image forming system according to claim 1, wherein each pieces of the first and second information includes information indicating: a type of a paper feed unit to which the paper feed tray belongs; size of paper stored in the paper feed tray; a paper type of the paper stored in the paper feed tray; weight of the paper stored in the paper feed tray; presence/absence of the paper stored in the paper feed tray; a remaining amount of the paper stored in the paper feed tray; an opening/closing state of the paper feed tray; or an adjustment value in the image forming unit for the paper stored in the paper feed tray.

3. The image forming system according to claim 1, wherein:

each of the control units in the upstream and downstream image forming apparatuses comprises a job control unit to control jobs and a printer control unit to control image formation and paper conveyance; and when the image forming system is powered on, the printer control unit of the upstream image forming apparatus sends the information related to the paper feed tray of the upstream image forming apparatus to the printer control unit of the downstream image forming apparatus, the printer control unit of the downstream image forming apparatus sends the information related to the paper feed tray of the downstream image forming apparatus to the printer control unit of the upstream image forming apparatus, the printer control unit of the upstream image forming apparatus sends the information related to the paper feed tray of the downstream image forming apparatus received from the printer control unit of the downstream image forming apparatus and the information related to the paper feed tray of the upstream image forming apparatus to the job control unit of the upstream image forming apparatus, and the printer control unit of the downstream image forming apparatus sends the information related to the paper feed tray of the upstream image forming apparatus received from the printer control unit of the upstream image forming apparatus and the information related to the paper feed tray of the downstream image forming apparatus to the job control unit of the downstream image forming apparatus.

4. The image forming system according to claim 1, wherein when the first information stored in the storage unit is changed in the own image forming apparatus, each of the control units of the upstream and downstream image forming apparatuses sends at least the changed pieces of information to the other image forming apparatus, from among the first information.

5. The image forming system according to claim 4, wherein:

each of the control units in the upstream and downstream image forming apparatuses comprises a job control unit to control jobs and a printer control unit to control image formation and paper conveyance; and when the first information stored in the storage unit is changed in the own image forming apparatus, each of the printer control units of the upstream and downstream image forming apparatuses sends at least the changed pieces of information from among the first information to the job control unit of the own image forming apparatus and the printer control unit of the other image forming apparatus, and the printer control unit of the other image forming apparatus sends the changed pieces of information to the job control unit of the other image forming apparatus.

6. The image forming system according to claim 4, wherein:

each of the control units in the upstream and downstream image forming apparatuses comprises a job control unit to control jobs and a printer control unit to control image formation and paper conveyance; and when the first information stored in the storage unit is changed from an operation section in the own image forming apparatus, each of the job control units of the upstream and downstream image forming apparatuses sends at least the changed pieces of information from among the first information to the printer control unit of the own image forming apparatus and the job control unit of the other image forming apparatus, and the job control unit of the other image forming apparatus sends the changed pieces of information to the printer control unit of the other image forming apparatus.

7. The image forming system according to claim 1, wherein:

each of the control units in the upstream and downstream image forming apparatuses comprises a job control unit to control jobs and a printer control unit to control image formation and paper conveyance; and regarding information including information for a front side of the paper and information for a reverse side of the paper from among the information related to the paper feed tray, each of the control units in the upstream and downstream image forming apparatuses stores therein both pieces of information for the front side of the paper and the reverse side of the paper, the printer control unit of the upstream image forming unit reads out the information for the front side stored in the storage unit of the upstream image forming apparatus and causes the image forming unit of the upstream image forming apparatus to perform image formation for the front side of the paper based on the read out information for the front side, and the printer control unit of the downstream image forming unit reads out the information for the reverse side stored in the storage unit of the downstream image forming apparatus and causes the image forming unit of the downstream image forming apparatus to perform image formation for the reverse side of the paper based on the read out information for the reverse side.

8. The image forming system according to claim 1, wherein in each of the upstream and the downstream image forming apparatuses, the control unit sends the first information related to the paper feed tray of the own image forming apparatus to the other image forming apparatus.

9. The image forming system according to claim 1, wherein in each of the upstream and the downstream image forming apparatuses, the control unit performs a check process regarding executability of a job in the own image forming apparatus, and when the control unit determines that the job is executable, the control unit causes the job in the own image forming apparatus to be executed by using paper stored in a paper feed tray which is appropriate for the job.

10. A non-transitory computer readable storage medium storing a program for an image forming system comprising a plurality of image forming apparatuses connected in series along a paper conveying direction, wherein an image forming apparatus provided upstream in the paper conveying direction among the plurality of image forming apparatuses prints one side of a sheet of paper and an image forming apparatus provided downstream with respect to the upstream image forming apparatus prints the other side of the sheet of paper, each of the upstream and downstream image forming apparatuses comprises an image forming unit, a storage unit, and a control unit, said program causing, in least one of said upstream and downstream image forming apparatuses, a process comprising:

making the storage unit of the own image forming apparatus store a first information related to a paper feed tray of the own image forming apparatus;

receiving a second information related to a paper feed tray of the other image forming apparatus from the other image forming apparatus;

the control unit of the own image forming apparatus makes the storage unit of the own image forming apparatus store the second information; and the control unit of the own image forming apparatus makes the image forming unit of the own image forming apparatus perform image formation based on the first and second information stored in the storage unit of the own image forming apparatus.

11. The non-transitory computer readable storage medium of claim 10, wherein each of the control units in the upstream and downstream image forming apparatuses comprises a job control unit to control jobs and a printer control unit to control image formation and paper conveyance, and wherein when the image forming system is powered on, said program causes:

the printer control unit of the upstream image forming apparatus to send the information related to the paper feed tray of the upstream image forming apparatus to the printer control unit of the downstream image forming apparatus, the printer control unit of the downstream image forming apparatus to send the information related to the paper feed tray of the downstream image forming apparatus to the printer control unit of the upstream image forming apparatus, the printer control unit of the upstream image forming apparatus to send the information related to the paper feed tray of the downstream image forming apparatus received from the printer control unit of the downstream image forming apparatus and the information related to the paper feed tray of the upstream image forming apparatus to the job control unit of the upstream image forming apparatus, and the printer control unit of the downstream image forming apparatus to send the information related to the paper feed tray of the upstream image forming apparatus received from the printer control unit of the upstream image forming apparatus and the information related to the paper feed tray of the downstream image forming apparatus to the job control unit of the downstream image forming apparatus.

* * * * *